US007874355B2

(12) United States Patent
O'Keefe et al.

(10) Patent No.: US 7,874,355 B2
(45) Date of Patent: Jan. 25, 2011

(54) METHODS AND APPARATUS FOR REMOVING DEPOSITS ON COMPONENTS IN A DOWNHOLE TOOL

(75) Inventors: Michael O'Keefe, Blackmans Bay Tasmania (AU); Sophie Nazik Godefroy, Kawasaki (JP); Nasser Dilmaghani Zadeh, Ville d'Avray (FR)

(73) Assignee: Schlumberger Technology Corporation, Sugar Land, TX (US)

( * ) Notice: Subject to any disclaimer, the term of this patent is extended or adjusted under 35 U.S.C. 154(b) by 222 days.

(21) Appl. No.: 12/167,211

(22) Filed: Jul. 2, 2008

(65) Prior Publication Data

US 2010/0000728 A1 Jan. 7, 2010

(51) Int. Cl.
*E21B 37/04* (2006.01)

(52) U.S. Cl. ..... 166/173

(58) Field of Classification Search ..... 166/170–175; 318/118

See application file for complete search history.

(56) References Cited

U.S. PATENT DOCUMENTS 3,395,759 A * 8/1968 Talley, Jr. ..... 166/155
5,267,616 A * 12/1993 Silva et al. ..... 166/311
5,828,143 A * 10/1998 Kotlyar ..... 310/26
7,260,985 B2 8/2007 Gilbert
7,675,253 B2 * 3/2010 Dorel ..... 318/118
2005/0257629 A1 11/2005 Gilbert et al.
2008/0093078 A1 4/2008 Vasques et al.

* cited by examiner

*Primary Examiner*—Kenneth Thompson
*Assistant Examiner*—James G Sayre
(74) *Attorney, Agent, or Firm*—Daryl Wright; Jody DeStefanis; Jeff Griffin

(57) ABSTRACT

Methods and apparatus for removing deposits on components in a downhole tool are described. An example apparatus to remove a deposit on an inner surface of a flowline in a downhole tool includes a movable scraper disposed in a flowline of a downhole tool. The movable scraper is configured to selectively obstruct the flowline so that a fluid flowing in the flowline moves the movable scraper in the flowline. Additionally, the movable scraper has an outer surface configured to engage an inner surface of the flowline so that movement of the outer surface along the inner surface removes a deposit on at least a portion of the inner surface.

38 Claims, 16 Drawing Sheets

METHODS AND APPARATUS FOR REMOVING DEPOSITS ON COMPONENTS IN A DOWNHOLE TOOL

FIELD OF THE DISCLOSURE

This patent relates generally to sampling and analyzing formation fluids and, more particularly, to methods and apparatus for removing deposits on components in a downhole tool.

BACKGROUND

Downhole fluid analysis is often used to provide information in real time about the composition of subterranean formation or reservoir fluids. Such real-time information can be advantageously used to improve or optimize the effectiveness of formation testing tools during sampling processes in a given well (e.g., downhole fluid composition analysis allows for reducing and/or optimizing the number of samples captured and brought back to the surface for further analysis). More generally, collecting accurate data about the characteristics of formation fluid(s) is an important aspect of making reliable predictions about a formation or reservoir and, thus, can have a significant impact on reservoir performance (e.g., production, quality, volume, efficiency, etc.).

Fluid characteristics such as composition, density, viscosity, formation water or formation fluid resistivity, etc. are typically measured using formation fluid testers that are deployed via wireline tools and/or logging-while-drilling (LWD) tools, both types of which are commonly available. Formation fluid testers often use sensors that are in-line with a flowline of a formation fluid tester portion of a wireline or LWD tool and which may be at least partially in contact with or exposed to fluid(s) in the flowline. As a result, over time, the sensors can become at least partially coated by impurities or deposits such as, heavy components, precipitated asphaltenes, mineral deposits, oil, water-based mud, or fine particles that may accumulate within the formation testers. If the sensor becomes contaminated with such impurities, the measurements made by the formation fluid tester device or equipment may be biased or inaccurate.

SUMMARY

An example apparatus to remove a deposit on an inner surface of a flowline in a downhole tool includes a movable scraper disposed in a flowline of a downhole tool. The movable scraper is configured to selectively obstruct the flowline so that a fluid flowing in the flowline moves the movable scraper in the flowline. Additionally, the movable scraper has an outer surface configured to engage an inner surface of the flowline so that movement of the outer surface along the inner surface removes a deposit on at least a portion of the inner surface.

Another example apparatus to clean an inner surface of a flowline in a downhole tool includes a body configured to move within a flowline of a downhole tool. The body comprises a central portion to obstruct the flowline so that a fluid flowing in the flowline moves the body in the flowline. Additionally, the body has an outer surface configured to engage an inner surface of the flowline so that movement of the outer surface along the inner surface is to clean at least a portion of the inner surface.

Another example apparatus to remove a deposit on a surface of a flowline in a downhole tool includes a movable scraper disposed in a flowline of a downhole tool that includes a magnetic portion to enable movement of the scraper in the flowline in response to a magnetic field. The movable scraper has a surface configured to engage a corresponding surface of the flowline so that movement of the surface along the corresponding surface removes a deposit on at least a portion of the corresponding surface.

DETAILED DESCRIPTION

Figure 1:
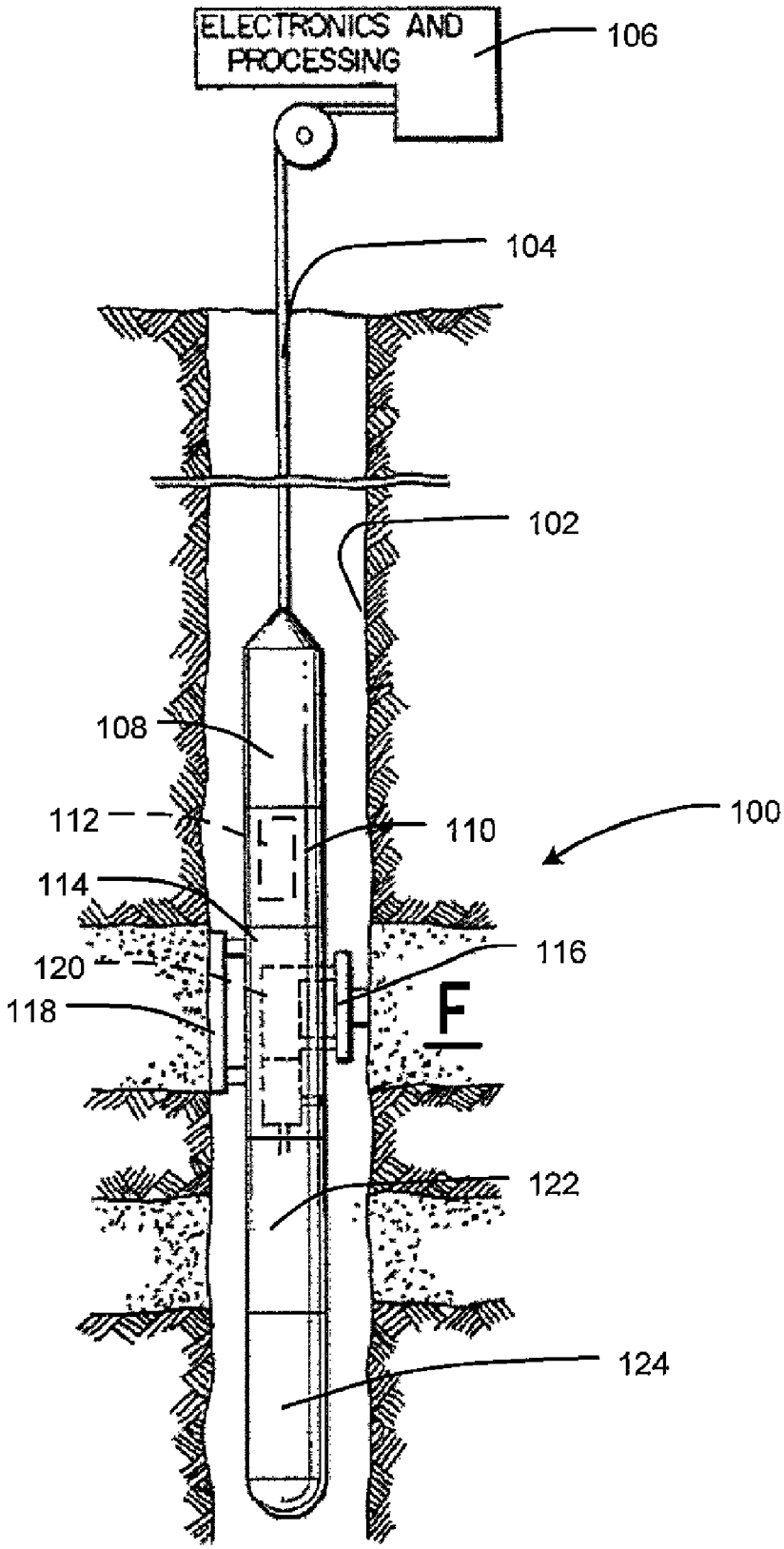
FIG. 1 depicts an example wireline tool that may be used to implement the methods and apparatus described herein.

Certain examples are shown in the above-identified figures and described in detail below. In describing these examples, like or identical reference numbers are used to identify common or similar elements. The figures are not necessarily to scale and certain features and certain views of the figures may be shown exaggerated in scale or in schematic for clarity and/or conciseness. Additionally, several examples have been described throughout this specification. Any features from any example may be included with, a replacement for, or otherwise combined with other features from other examples.

The example methods and apparatus described herein can be used to clean and/or remove deposits from a flowline within a wireline tool. In particular, the example methods and apparatus described herein involve obtaining a fluid sample, analyzing the fluid sample, determining the presence of deposits within a flowline, and cleaning and/or removing deposits from a flowline in a downhole tool. In the illustrated examples described herein, the deposits can by cleaned and/or removed by moving a scraper or other body relative to the flowline. Specifically, an actuator may move the scraper from a first storage position into a flow path of a fluid, which moves the scraper though the flowline to a second storage position opposite the first storage position. As the scraper moves through the flowline, a surface (e.g., a peripheral or outer surface) of the scraper engages an inner surface of the flowline to remove the deposits. The first and second storage positions are substantially outside of the fluid flow path and, thus, when the scraper is located in one of the storage positions, it does not interfere or substantially obstruct the flow of fluid (e.g., formation fluid being sampled) in the flowline.

Some of the example methods and apparatus described herein can be used to hold a plurality of scrapers that are moved within a flowline. Specifically, a storage unit may hold the plurality of scrapers adjacent a first storage position and may selectively deposit or dispose the scrapers in the first storage position. An actuator may move a scraper from the first storage position into a flow path of a fluid, which moves the scraper though the flowline to a restriction which, in turn, restricts (e.g., stops) the scraper from proceeding further through the flowline. As the scraper moves through the flowline, the scraper engages at least a portion of an inner surface of the flowline to remove the deposits. The scraper may include a pressure relief member (e.g., a membrane or a hydraulic fuse) that opens or breaks to enable fluid to flow through the scraper and the restriction in the flowline. In some examples, breakage of the membrane and/or opening the hydraulic fuse creates a transient fluid flow that can further remove deposits from the flowline.

In other examples, one or more electrical coils may be used to emit a magnetic field that actuates a rotatable flap within a scraper to an activated position. In the activated position, the rotatable flap is substantially perpendicular to a flow path of the fluid and obstructs the flow of the fluid so that the fluid moves the scraper through the flowline. To deactivate the scraper, the one or more coils emit an opposite magnetic field that actuates the rotatable flap to be substantially parallel to the flow of fluid and, thus, enables the fluid to pass or flow through the scraper. In some examples, the rotatable flap includes a pressure relief member that opens or breaks to enable fluid to flow through the scraper if the scraper becomes locked, jammed, etc. in the activated position.

In still other examples, one or more electrical coils may be used to emit a magnetic field that repels or attracts a scraper within a flowline. Specifically, the scraper includes a magnetic portion having a polarity that is substantially parallel to the flowline. Additionally, the one or more electrical coils may include portions that have a magnetic polarity that may be changed between a south magnetic polarity and a north magnetic polarity to move the scraper within the flowline. In some examples, the magnetic field emitted by the one or more electrical coils may be constant. However, in other examples, a magnitude of the magnetic field emitted by the one or more electrical coils may change depending on the position of the scraper relative to the one or more electrical coils.

Some of the example methods and apparatus described herein can be used to move a scraper within a flowline by moving an electrical coil or magnet relative to the flowline. Specifically, the scraper includes a magnetic portion that responds to a magnetic field emitted by the magnet. More specifically, the magnet is coupled to a cable or track that may be moved relative to the flowline by one or more winches. In some examples, the scraper defines a recess that corresponds to a portion of a sensor positioned in the flowline. Additionally, the scraper may define a groove that corresponds to a rib to assist in aligning the recess relative to the sensor and to substantially prevent the scraper from rotating within the flowline.

FIG. 1 depicts an example wireline tool 100 that may be used to extract and analyze formation fluid samples and which may be used to clean, remove and/or prevent the accumulation of deposits on various components in the wireline tool 100 using the example methods and apparatus described herein. The deposits may be associated with a formation fluid or a drilling fluid. As shown in FIG. 1, the example wireline tool 100 is suspended in a borehole or wellbore 102 from the lower end of a multiconductor cable 104 that is spooled on a winch (not shown) at the surface. At the surface, the cable 104 is communicatively coupled to an electronics and processing system 106. The wireline tool 100 includes an elongated body 108 that includes a collar 110 having a downhole control system 112 configured to control extraction of formation fluid from the formation F, measurements performed on the extracted fluid as well as to control the example flowline cleaning or deposit removal apparatus described herein.

The example wireline tool 100 also includes a formation tester 114 having a selectively extendable fluid admitting assembly 116 and a selectively extendable tool anchoring member 118 that are respectively arranged on opposite sides of the body 108. The fluid admitting assembly 116 is configured to selectively seal off or isolate selected portions of the wall of the wellbore 102 to fluidly couple the adjacent formation F and draw fluid samples from the formation F. The formation tester 114 also includes a fluid analysis module 120 through which the obtained fluid samples flow. The fluid may thereafter be expelled through a port (not shown) or it may be sent to one or more fluid collecting chambers 122 and 124, which may receive and retain the formation fluid for subsequent testing at the surface or a testing facility.

In the illustrated example, the electronics and processing system 106 and/or the downhole control system 112 are configured to control the fluid admitting assembly 116 to draw fluid samples from the formation F and to control the fluid analysis module 120 to measure the fluid samples. In some example implementations, the fluid analysis module 120 may be configured to analyze the measurement data of the fluid samples as described herein. In other example implementations, the fluid analysis module 120 may be configured to generate and store the measurement data and subsequently communicate the measurement data to the surface for analysis at the surface. Although the downhole control system 112 is shown as being implemented separate from the formation tester 114, in some example implementations, the downhole control system 112 may be implemented in the formation tester 114.

As described in greater detail below, the example wireline tool 100 may be used in conjunction with the example methods and apparatus to clean, remove and/or prevent the accumulation of deposits on various components in the wireline tool 100. For example, the formation tester 114 may include one or more fluid analyzers or fluid measurement units disposed adjacent a flowline and may be controlled by one or both of the downhole control system 112 and the electronics and processing system 106 to determine the composition of or a characteristic of fluid samples extracted from, for example, the formation F. In addition, in accordance with the example methods and apparatus described herein, the formation tester 114 is provided with various means to clean, remove and/or prevent the accumulation of deposits on various components in the wireline tool 100.

While the example methods and apparatus to clean, remove and/or prevent the accumulation of deposits on components are described in connection with a wireline tool such as that shown in FIG. 1, the example methods and apparatus can be implemented with any other type of wellbore conveyance. For example, the example methods and apparatus can be implemented with a drill string including LWD and/or measurement-while-drilling (MWD) modules, coiled tubing, etc.

Figure 2:
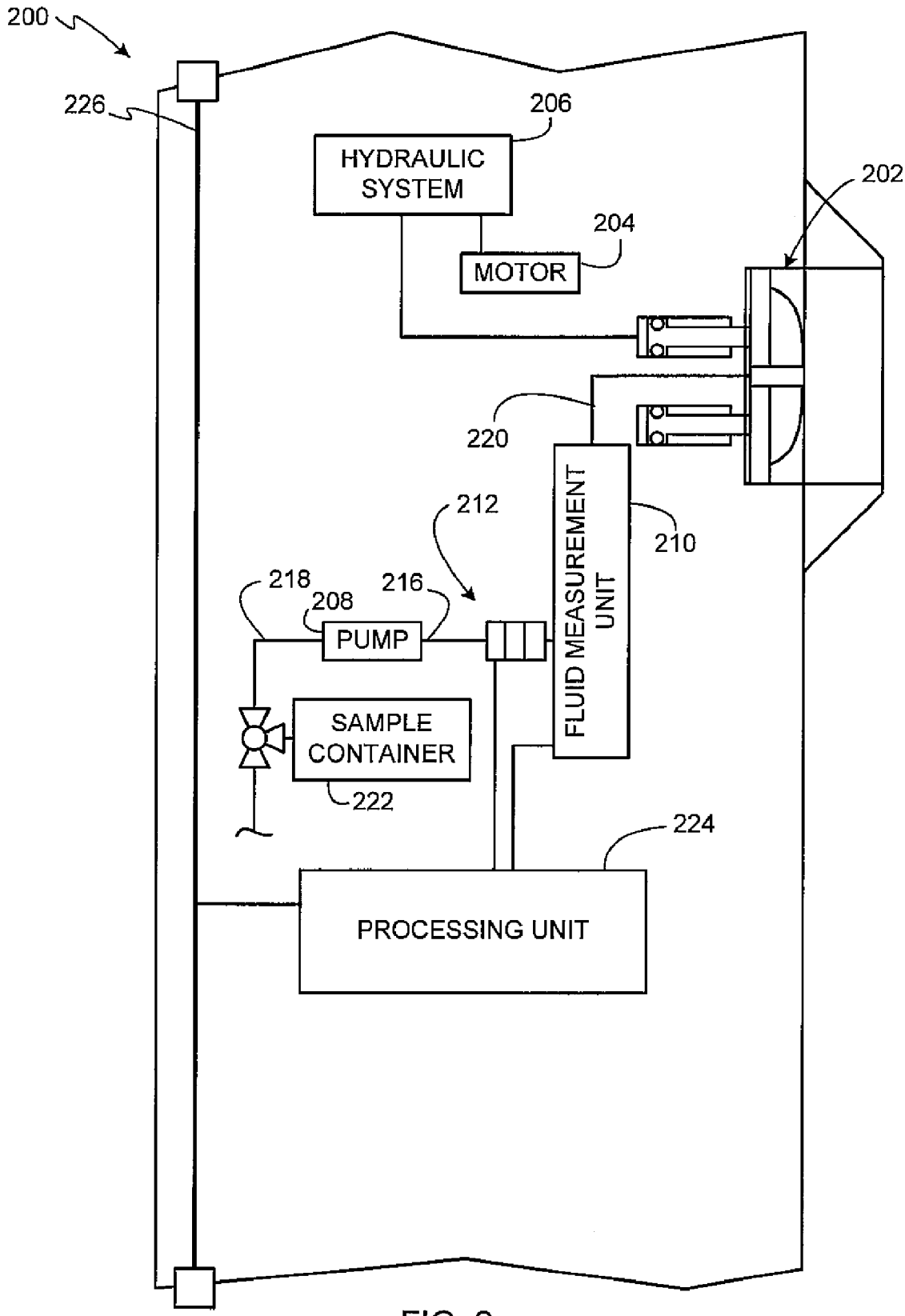
FIG. 2 is a simplified schematic illustration of an example manner in which the formation tester of FIG. 1 may be implemented.

FIG. 2 is a simplified schematic illustration of an example formation sampling tool 200 that may be used to implement the formation tester 114 of FIG. 1. The example formation sampling tool 200 includes a probe assembly 202 that can be selectively engaged to a surface of a wellbore via a motor 204 and a hydraulic system 206 to draw fluids from a formation. In other example implementations, straddle packers (not shown) can additionally or alternatively be used to engage and isolate a portion of the surface of the wellbore to draw fluids from a formation. The formation sampling tool 200 is also provided with a pump 208 that may be used to draw fluids from a formation into the formation sampling tool 200.

The formation sampling tool 200 includes one or more fluid sensors to measure characteristics of the fluids drawn into the formation sampling tool 200. More specifically, in the illustrated example, the formation sampling tool 200 is provided with a fluid measurement unit 210 to measure one or more characteristics of formation fluids. The formation fluids may comprise at least one of a heavy oil, a bitumen, a gas condensate, a drilling fluid, a wellbore fluid or a fluid extracted from a subsurface formation. The fluid measurement unit 210 may be implemented using, for example, a light absorption spectrometer having a plurality of channels, each of which may correspond to a different wavelength. Thus, the fluid measurement unit 210 may be used to measure spectral information for fluids drawn from a formation. Such spectral information may include characteristic values such as optical density values associated with each of the channels and may be used, for example, to determine the composition of the fluid(s).

The formation sampling tool 200 is also provided with one or more sensors 212 to measure pressure, temperature, density, fluid resistivity, viscosity, and/or any other fluid properties or characteristics. While the sensors 212 are depicted as being in-line with a flowline 216, one or more of the sensors 212 may be used in other flowlines 218 and 220 within the example formation sampling tool 200. To measure fluid characteristics, the one or more sensors 212 and/or the fluid measurement unit 210 are in contact with or exposed to the fluid (s) in the flowline 216 and, as a result, deposits from the fluid may accumulate on the sensors 212 and/or in the fluid measurement unit 210, ultimately resulting in biased or inaccurate measurements. As described below in conjunction with FIGS. 3-16, the sensors 212 and/or the fluid measurement unit 210 are provided with various means to clean, remove and/or prevent the accumulation of deposits on various components (e.g., interior flowline surfaces, sensor windows, sensor surfaces, etc.) in the formation sampling tool 200. The formation sampling tool 200 may also include a fluid sample container or store 222 including one or more fluid sample chambers in which formation fluid(s) recovered during sampling operations can be stored and brought to the surface for further analysis and/or confirmation of downhole analyses. In other example implementations, the fluid measurement unit 210 and/or the sensors 212 may be positioned in any other suitable position such as, for example, between the pump 208 and the fluid sample container or store 222.

Figure 16:
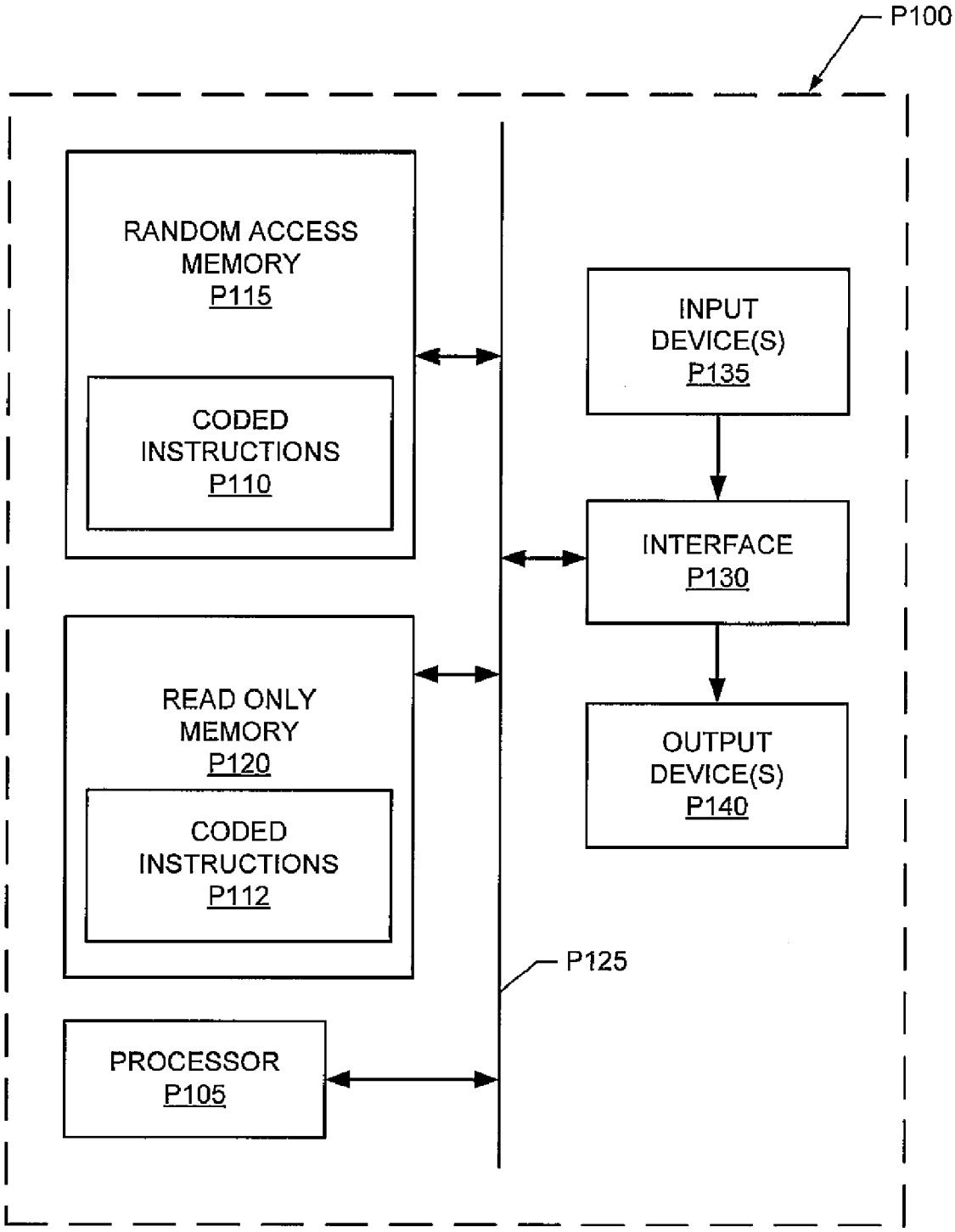
FIG. 16 is a schematic illustration of an example processor platform that may be used and/or programmed to implement any or all of the example methods and apparatus described herein.

To store, analyze and/or process test and measurement data (or any other data acquired by the formation sampling tool 200), the formation sampling tool 200 is provided with a processing unit 224, which may be generally implemented as shown in FIG. 16. In the illustrated example, the processing unit 224 may include a processor (e.g., a CPU and random access memory such as shown in FIG. 16) to control operations of the formation sampling tool 200 and implement measurement routines. For example, the processing unit 224 may be used to control the fluid measurement unit 210 to perform spectral measurements of fluid characteristics of formation fluid and to clean, remove and/or prevent the accumulation of deposits on various components in the formation sampling tool 200. The processing unit 224 may further include any combination of digital and/or analog circuitry needed to interface with the sensors 212 and/or the fluid measurement unit 210.

To store machine readable instructions (e.g., code, software, etc.) that, when executed by the processing unit 224, cause the processing unit 224 to implement measurement processes or any other processes described herein, the processing unit 224 may be provided with an electronic programmable read only memory (EPROM) or any other type of memory (not shown). To communicate information when the formation sampling tool 200 is downhole, the processing unit 224 is communicatively coupled to a tool bus 226, which may be communicatively coupled to a surface system (e.g., the electronics and processing system 106).

Although the components of FIG. 2 are shown and described above as being communicatively coupled and arranged in a particular configuration, the components of the formation sampling tool 200 can be communicatively coupled and/or arranged differently than depicted in FIG. 2 without departing from the scope of the present disclosure. In addition, the example methods and apparatus described herein are not limited to a particular conveyance type but, instead, may be implemented in connection with different conveyance types including, for example, coiled tubing, wireline, wired-drill-pipe, and/or other conveyance means known in the industry.

Figure 3:
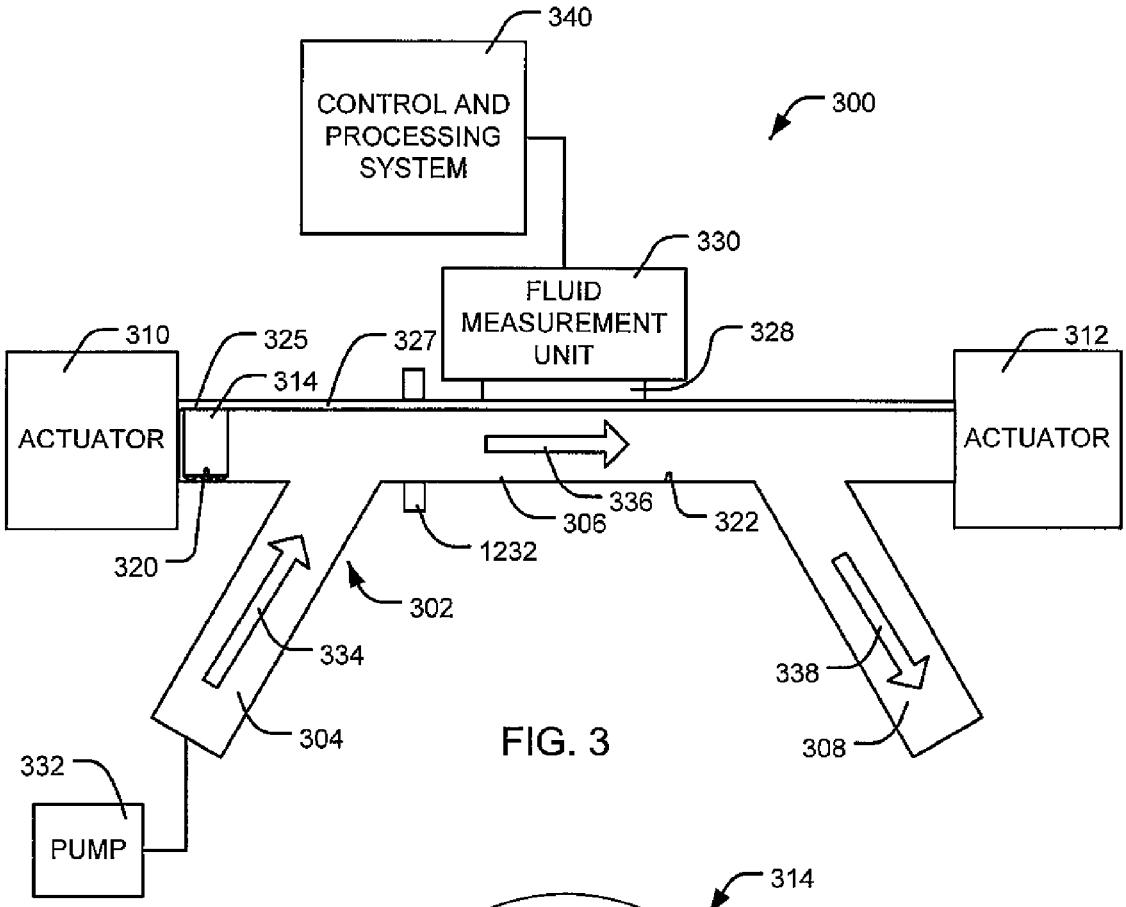
FIG. 3 is a schematic illustration of an example apparatus that may be used to implement or in conjunction with the fluid measurement unit of FIG. 2.

FIG. 3 illustrates an example apparatus 300 that may be used to implement a portion of the formation sampling tool 200 associated with the fluid measurement unit 210 and/or the sensors 212 of FIG. 2. The example apparatus 300 includes a flowline 302 that includes a first portion 304, a second portion 306, and a third portion 308. The first portion 304 and the third portion 308 are offset relative to (i.e., are not in-line with) the second portion 306.

A first actuator 310 and a second actuator 312 are coupled to opposite ends of the second portion 306. The first actuator 310 and the second actuator 312 are configured to dispose, move and/or push a slug, body or scraper 314 into a flow path of a fluid that flows through the flowline 302. In this example implementation, the scraper 314 is substantially cylindrical. However, other geometries could be used without departing from the scope of the examples described herein. The first and/or second actuator(s) 310 and 312 may include any suitable means to push and/or move the scraper 314 such as, for example, hydraulic components, mechanical components, and/or pneumatic components. In some example implementations, the first actuator 310 and/or the second actuator 312 may include a piston (not shown) that extends to push and/or move the scraper 314 into the fluid flow.

An external surface 320 of the scraper 314 has a diameter and/or the scraper 314 has a cross-section that substantially corresponds to a diameter of an inner surface 322 and/or cross-section of the second portion 306 of the flowline 302 such that the external surface 320 at least partially flexibly engages the inner surface 322. In other example implementations, the second portion 306 of the flowline 302 and the scraper 314 may have any other suitable corresponding or complementary geometries. Additionally, the scraper 314 may define a groove 325 that corresponds to a rib 327 that may assist in guiding the scraper 314 within the second portion 306 and may substantially prevent the scraper 314 from rotating within the second portion 306.

Figure 4:
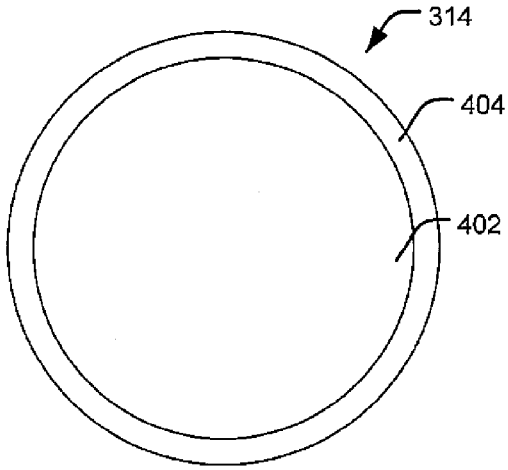
FIG. 4 depicts an end view of the example scraper of FIG. 3.

Turning briefly to FIG. 4, the scraper 314 may be made of a single piece of material or a plurality of different materials. In some examples, the scraper 314 includes an interior portion 402 and an exterior portion 404. The exterior portion 404 may be made of a relatively softer material as compared to the interior portion 402. For example, the exterior portion 404 may be made of a rubber material or any other suitable material that will not damage (e.g., scratch) a window 328 (FIG. 3) of a fluid measurement unit 330 (FIG. 3) as the scraper 314 moves through the second portion 306. Specifically, as the scraper 314 moves through the second portion 306, the exterior portion 404 rubs, wipes and/or scrapes against the inner surface 322 to remove and/or dislodge deposits within the second portion 306 of the flowline 302. The interior portion 402 may be made of the same or a different material as the exterior portion 404. For example, the interior portion 402 may be a ceramic material, a relatively hard rubber material, or a metal material and the exterior portion 404 may be made of a relatively soft or compliant rubber material. The scraper 314 may include a pressure relief member such as, for example, a membrane section (not shown) and/or a hydraulic fuse (not shown) that may break or release the fluid if exposed to a predetermined amount of fluid pressure or a predetermined pressure differential. The membrane may be made of any suitable material such as, for example, a silicon material, a rubber material etc. and may have a thickness that withstands a predetermined amount of pressure. For example, if the scraper 314 is unable to move within the second portion 306 and the fluid flow is substantially restricted, the membrane may break and enable fluid to flow through the scraper 314 even though the scraper 314 is within the fluid flow path of the second portion 306. Alternatively, if the scraper 314 is unable to move within the second portion 306 and the fluid flow is substantially restricted, the hydraulic fuse may open and enable fluid to flow through the scraper 314 even though the scraper 314 is within the fluid flow path of the second portion 306.

Turning back to FIG. 3, the fluid measurement unit 330 may be used to implement the fluid measurement unit 210 and/or the sensors 212 of FIG. 2. The fluid measurement unit 330 is provided with the window 328 that is substantially adjacent to and/or flush with the inner surface 322 of the second portion 306 and, thus, the window 328 does not substantially restrict the movement of the scraper 314. In other example implementations, the fluid measurement unit 330 may be provided with any other suitable sensor and/or interface that comes in contact with the fluid (e.g., formation fluid) and may be associated with obtaining measurements from the fluid. The fluid measurement unit 330 may be any suitable fluid measurement unit and/or sensor such as, for example, a spectrometer (e.g., as discussed in connection with FIG. 2), a fluorescence window, a tuning fork, a density sensor (e.g., a vibrating object for density measurement), a viscosity sensor (e.g., a vibrating object for viscosity measurement), a resistivity sensor, an ohmmeter, an X-ray detector, a nuclear magnetic resonance (NMR) sensor, a pH meter, a carbon dioxide meter, a hydrogen sulfide detector, a flow meter, a pressure sensor, a temperature sensor, or an imaging device (e.g., a charge coupled device (CCD)).

In some example implementations, the scraper 314 may include a magnetic portion (not shown). Additionally, as described in more detail below in connection with FIG. 12, the example apparatus 300 may be provided with a coil 1232 to determine the position and/or direction in which the scraper 314 is moving within the flowline 302.

In operation, a pump 332 pumps fluid (e.g., formation fluid) through the flowline 302 in a direction generally indicated by arrows 334, 336 and 338, and the fluid measurement unit 330 measures various parameters of the fluid such as the composition or a characteristic of a fluid sample. The pump 332 may be used to implement the pump 208 of FIG. 2. The fluid may include impurities such as, for example, heavy components, precipitated asphaltenes, various minerals, and/or fine particles that may accumulate within the flowline 302 and/or on the window 328 and distort or otherwise bias and render inaccurate the measurements obtained by the fluid measurement unit 330.

In some examples, a control and processing system 340 compares measurements received from the fluid measurement unit 330 to identify a trend of measurements that may indicate the presence and/or accumulation of deposits within the flowline 302 and/or on the window 328. The control and processing system 340 may be used to implement the processing unit 224 of FIG. 2. In other example implementations, the control and processing system 340 may compare measurements received from the fluid measurement unit 330 with other measurements received from other fluid measurement units 210 (FIG. 2) or sensors 212 (FIG. 2) within the formation sampling tool 200 (FIG. 2) to identify a substantial difference between the measurements received. A substantial difference between these received measurements may indicate the presence and/or accumulation of deposits within the flowline 302 and/or on the window 328. In other examples, the control and processing system 340 compares actual measurements to theoretical and/or reference measurements to identify a substantial difference between the actual measurements and the theoretical and/or reference measurements that may indicate the presence and/or accumulation of deposits within the flowline 302 and/or on the window 328. The fluid parameter measurement, comparison, and presence detection operations described herein may be performed periodically (e.g., at a certain time interval) or substantially continuously to suit the needs of a particular application.

If a predetermined time has expired, a predetermined number of measurements have been obtained by the fluid measurement unit 330 and/or if it is determined that there are deposits on the window 328 and/or in the flowline 302, the first actuator 310 may push, dispose, and/or move the scraper 314 from a first position (e.g., a first storage position) adjacent the first actuator 310 into the flow of fluid. Once the scraper 314 is in the fluid flow, the scraper at least partially obstructs the fluid flow and the fluid moves the scraper 314 through the second portion 306 to a second position (e.g., a second storage position) adjacent the second actuator 312. As the scraper 314 moves through the second portion 306, the external surface 320 at least partially flexibly engages the inner surface 322 of the second portion 306 to remove deposits (or a portion thereof) within the flowline 302 and/or on the window 328. To move the scraper 314 from the second position back to the first position, the pump 332 reverses the flow of fluid through the flowline 302 (i.e., in a direction opposite the arrows 334, 336 and 338), and the second actuator 312 then moves and/or pushes the scraper 314 from the second position into the flow of fluid. The flow of fluid (as caused by the pump 332) moves the scraper 314 through the second portion 306 until the scraper 314 returns to the first position adjacent the first actuator 310. In the first and second storage positions, the scraper 314 is substantially outside of and/or not in-line with the flow path of fluid in the flowline 302.

Figure 5:
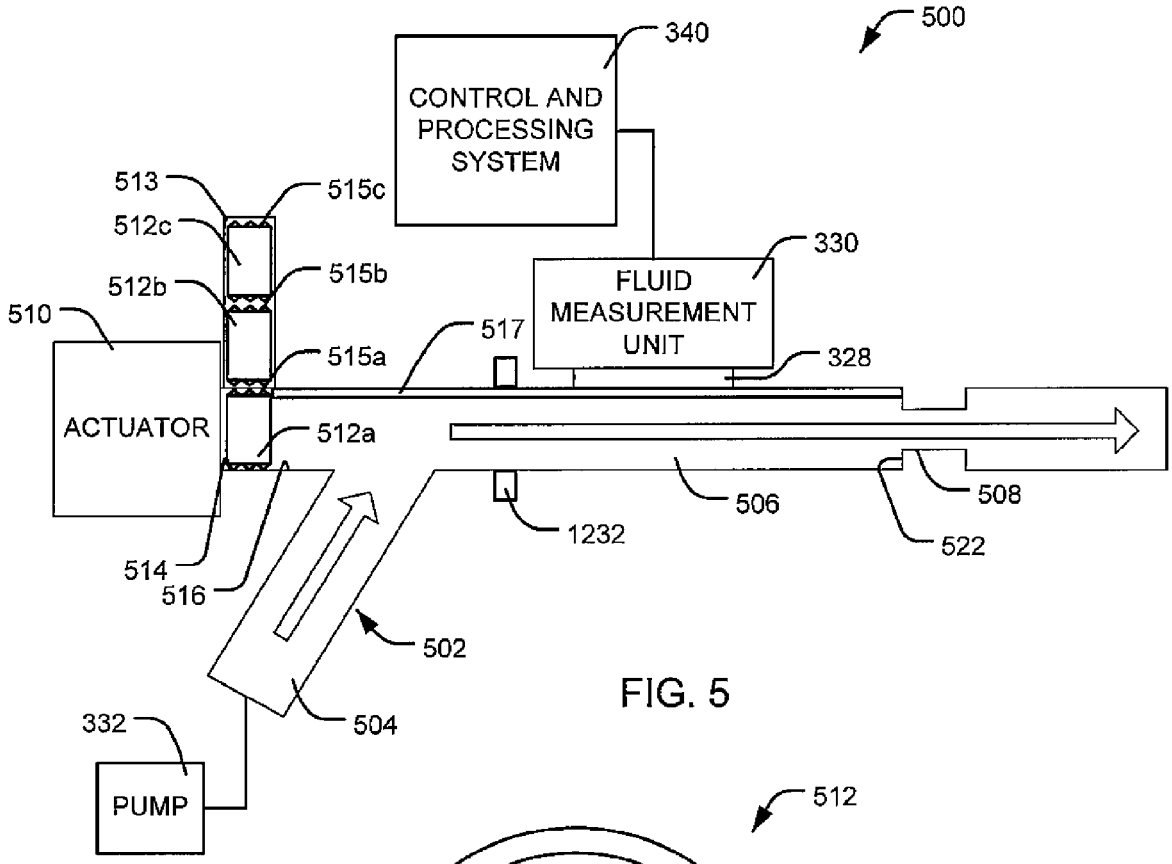
FIG. 5 is a schematic illustration of another example apparatus that may be used to implement or in conjunction with the fluid measurement unit of FIG. 2.

FIG. 5 illustrates another example apparatus 500 that may be used to implement a portion of the formation sampling toot 200 associated with the fluid measurement unit 210 and/or the sensors 212 of FIG. 2. The example apparatus 500 includes a flowline 502 that includes a first portion 504, a second portion 506 and a restricted portion 508. The first portion 504 is offset relative to (i.e., is not in-line with) the second portion 506 and the restricted portion 508 is in-line with the second portion 506.

An actuator 510 is coupled to the second portion 506 opposite the restricted portion 508 and may include any suitable means to push, dispose, and/or move a slug, body or scraper 512*a*, 512*b*, and/or 512*c* into a flow of fluid such as, for example, hydraulic components, mechanical components, and/or pneumatic components. In this example implementation, the scraper 512 is substantially cylindrical. However, other geometries could be used without departing from the scope of the examples described herein. Additionally, a scraper storage unit 513 may be provided to store a plurality of scrapers 512 (e.g., 2, 3, 4, etc.) that may be pushed and/or moved separately and/or together by the actuator 510 into the flow of fluid. An external surface 514 of the scrapers 512 have a diameter and/or the scrapers 512 have a cross-section that substantially corresponds to a diameter of an inner surface 516 and/or cross-section of the second portion 506 of the flowline 502 such that the external surface 514 slidably engages the inner surface 516 of the flowline 502. In other example implementations, the second portion 506 of the flowline 502 and the scrapers 512 may have any other suitable corresponding or complementary geometries. Although three scrapers 512*a*, 512*b* and 512*c* are shown in FIG. 5, any other number of scrapers may be included (e.g., 1, 2, 3, 4, 5, etc.) instead. Additionally, the scrapers 512*a*, 512*b*, 512*c* may each define a groove 515*a*, 515*b*, and 515*c* that corresponds to a rib 517 once the scraper 512*a*, 512*b*, and 512*c* is in the first position. The interaction between the groove 515*a*, 515*b* and 515*c* and the rib 517 may assist in guiding the scraper 512*a*, 512*b* and 512*c* within the second portion 506 and may substantially prevent the scraper 512*a*, 512*b* and 512*c* from rotating within the second portion 506.

Figure 6A:
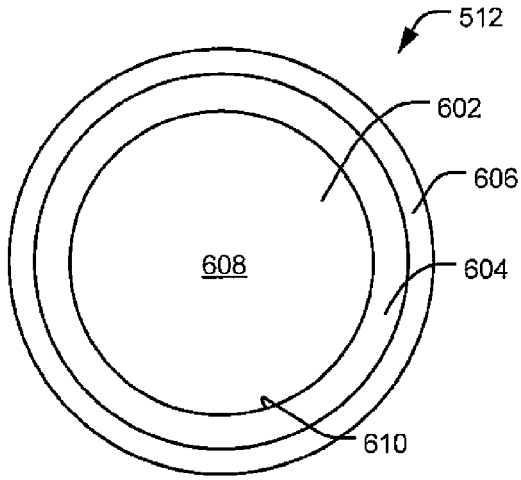
FIG. 6*a* depicts an end view of another example scraper of FIG. 5.

Turning briefly to FIG. 6*a*, the scraper 512 is made of a plurality of materials. In some examples, the scraper 512 is provided with a membrane portion 602, a middle portion 604 and an exterior portion 606. The membrane portion 602 may be made of any suitable material such as, for example, a silicon material, a rubber material (e.g., a nitrile rubber) that may be exposed to conditions and/or fluids (e.g., formation fluid, temperature, pressure, etc.) present in a downhole environment. Additionally, the membrane portion 602 may have a thickness to withstand a pressure and to break when a predetermined amount of pressure (e.g., a predetermined fluid pressure) is applied to a face 608 of the membrane portion 602. Specifically, the membrane portion 602 may be selected to break when exposed to 500 pounds per square inch (PSI) or 1000 PSI or any suitable pressure (e.g., 100 PSI, 200 PSI, 300 PSI, etc.). The exterior portion 606 may be made of a relatively softer material as compared to the middle portion 604. For example, the exterior portion 606 may be made of a rubber material or any other suitable material that will substantially not damage (e.g., scratch) the window 328 (FIG. 5) as the scraper 512 moves through the second portion 506 of the flowline 502. The middle portion 604 may be made of the same or a different material as the exterior portion 606 such as, for example, a ceramic material, a rubber material, a metal material etc.

Figure 6B:
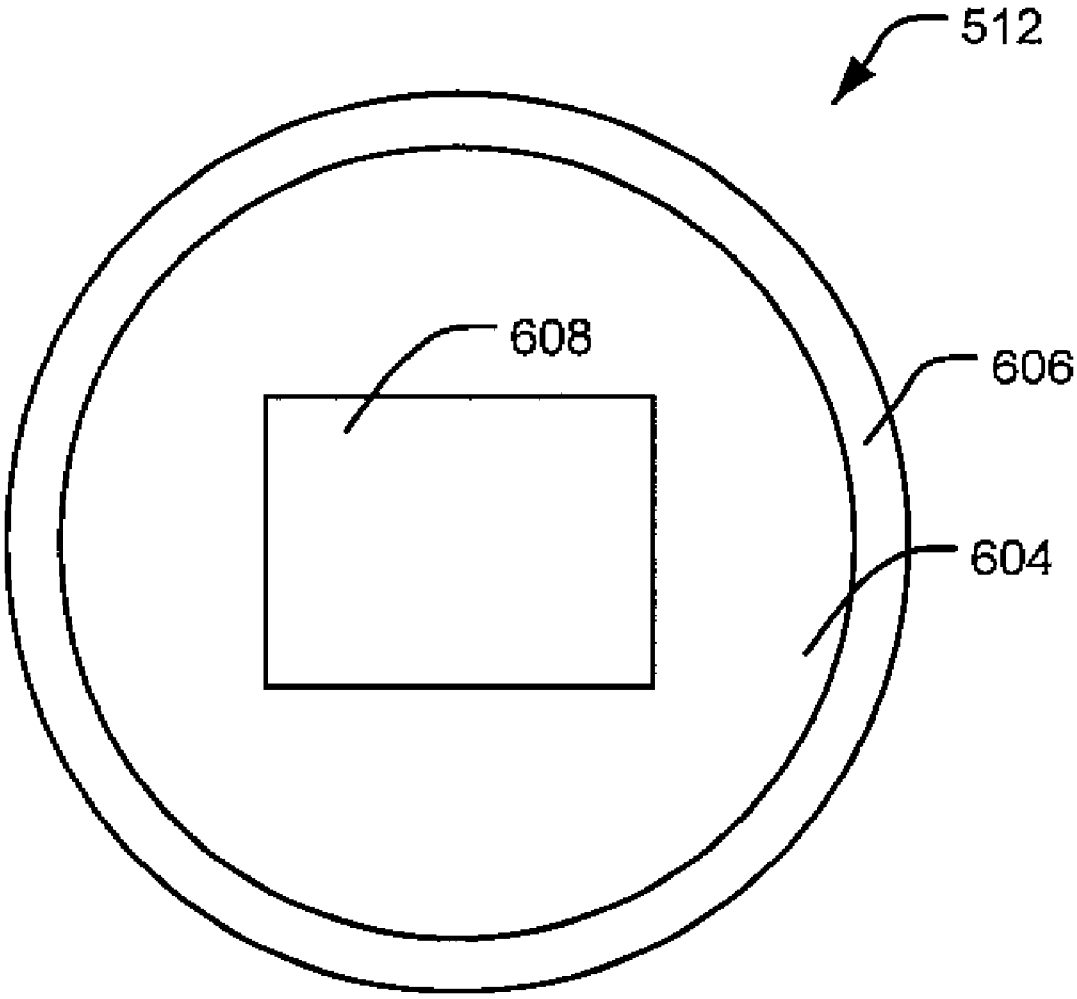
FIG. 6*b* depicts an end view of another example scraper of FIG. 5.

FIG. 6*b* depicts the scraper 512 that is provided with a hydraulic fuse 608 in place of the membrane portion 602 (FIG. 6*a*). The hydraulic fuse 608 actuates between a closed position, as shown in FIG. 6*b*, and an open position (not shown), when a predetermined condition occurs. Generally, the hydraulic fuse 608 acts as a pressure relief valve to vent excess pressure. In this example implementation, the hydraulic fuse 608 opens when a predetermined pressure differential is applied across the scraper 512 to enable fluid to flow through the scraper 512. Specifically, the hydraulic fuse 608 may be selected to actuate when exposed to a pressure differential of 500 pounds per square inch (PSI) or 1000 PSI or any suitable pressure differential (e.g., 100 PSI, 200 PSI, 300 PSI, etc.).

Turning back to FIG. 5, as discussed above, the example apparatus 500 includes the fluid measurement unit 330 that is provided with the window 328 that may be used to implement the fluid measurement unit 210 and/or the sensors 212 of FIG. 2. The window 328 is substantially adjacent to and/or flush with the inner surface 516 so that the window 328 does not substantially restrict the movement of the scraper 512 through the second portion 506. In other example implementations, the fluid measurement unit 330 may be provided with any other suitable sensor and/or interface that comes in contact with the fluid (e.g., formation fluid) and may be associated with obtaining measurements from the fluid.

In some example implementations, the scraper 512 may include a magnetic portion (not shown). Additionally, as described in more detail below in connection with FIG. 12, the example apparatus 500 may be provided with the coil 1232 to determine the position and/or direction in which the scraper 512 is moving within the second portion 506.

In operation, if a predetermined time has expired, a predetermined number of measurements have been obtained by the fluid measurement unit 330 and/or if it is determined that there are deposits on the window 328 and/or in the flowline 502, the actuator 510 may push and/or move one or more of the scrapers 512*a*, 512*b* and/or 512*c* from a first position (e.g., a first storage position) adjacent the actuator 510 into the flow of fluid. If for example, the actuator 510 moves the scraper 512*a* into the second portion 506, the scraper 512*b* is then deposited from the scraper storage unit 513 into the first position and is ready to be moved into the flow of fluid. In some examples, the scraper storage unit 513 may include a sliding panel (not shown) or any other suitable means to substantially separate the scraper storage unit 513 from the first position and, thus, the scraper(s) 512 within the scraper storage unit 513 do not prevent and/or restrict the actuator 510 from moving the scraper 512 in the first position into the flow of fluid. In the first storage position, the scraper 512 is substantially outside of and/or not in line with the flow path of fluid.

Once the scraper 512 is in the fluid flow, the scraper 512 at least partially obstructs the flow and the flow of fluid moves the scraper 512 through the second portion 506 to a second position adjacent the restricted portion 508. The restricted portion 508 substantially restricts the movement of the scraper 512. As the scraper 512 moves through the second portion 506, the external surface 514 at least partially flexibly engages the inner surface 516 of the second portion 506 to remove deposits (or a portion thereof) within the flowline 502 and/or on the window 328. After the scraper 512 engages a surface 522 of the restricted portion 508, the membrane portion 602 (FIG. 6*a*) of the scraper 512 substantially prevents additional fluid from flowing through the restricted portion 508 and, thus, the pressure of the fluid within the second portion 506 adjacent the scraper 512 increases. Once the pressure within the flowline 502 reaches a predetermined pressure, the membrane portion 602 (FIG. 6*a*) breaks in response to the increase in fluid pressure. In some examples, the pressure at which the membrane portion 602 (FIG. 6*a*) breaks is sufficient to cause a transient fluid flow in the flowline 502. The transient fluid flow may remove at least some remaining deposits from the flowline 502 and/or the window 328. Breaking the membrane portion 602 (FIG. 6*a*) enables the fluid to flow through an opening 610 (FIG. 6*a*) defined by the middle portion 604 (FIG. 6*a*). Even if the membrane portion 602 (FIG. 6*a*) completely detaches from the scraper 512, the middle and exterior portions 604 and 606 (FIG. 6*a*) remain adjacent the restricted portion 508. If a predetermined time has again expired, the predetermined number of measurements have been obtained by the fluid measurement unit 330 and/or if it is again determined that there are deposits on the window 328 and/or in the flowline 502, the actuator 510 may push and/or move another scraper (e.g., 512*b* or 512*c*) from the first position adjacent the actuator 510 into the flow of fluid as described above.

Figure 7:
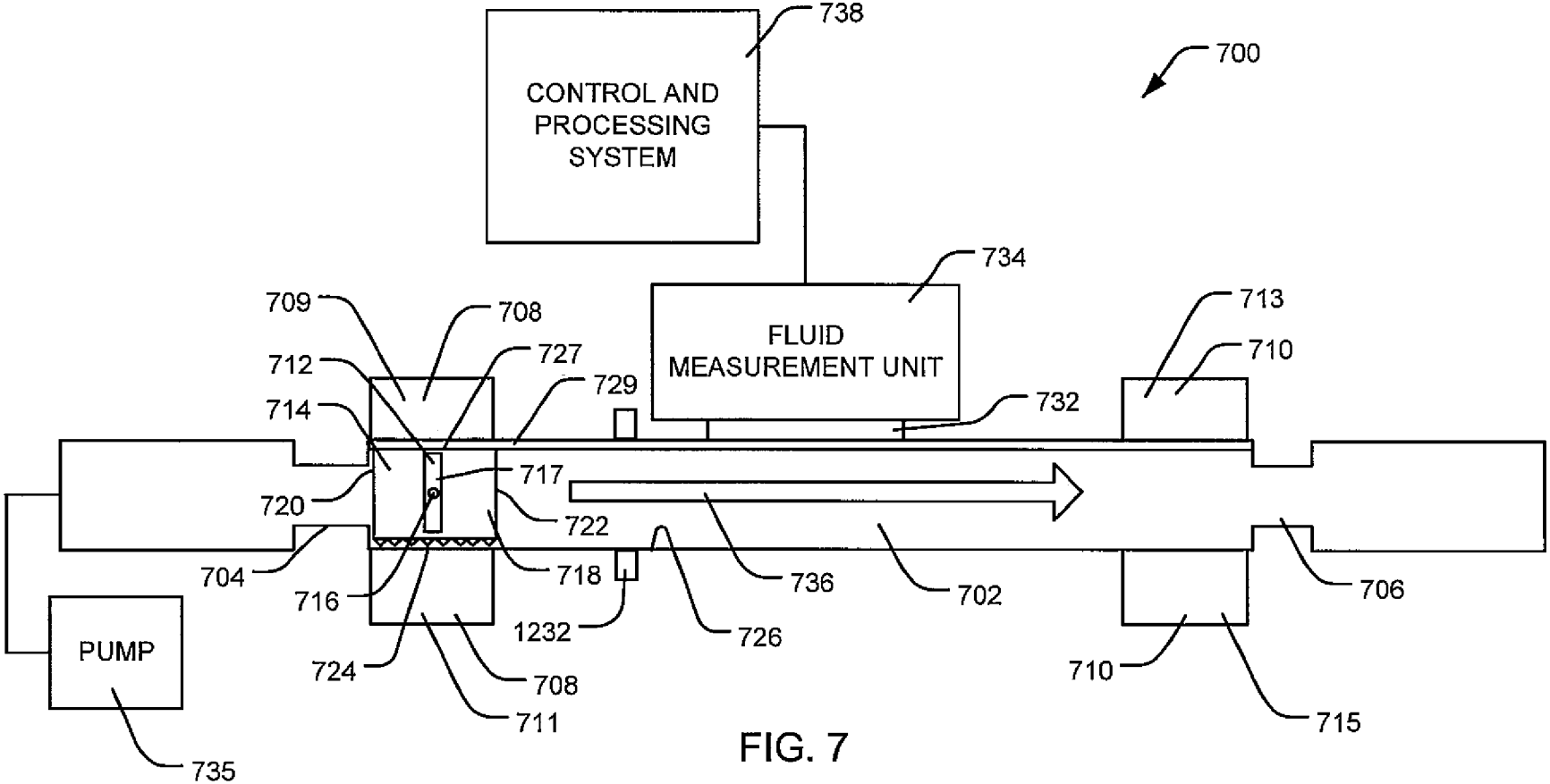
FIG. 7 is a schematic illustration of another example apparatus that may be used to implement or in conjunction with the fluid measurement unit of FIG. 2 in an activated state prior to cleaning the flowline.
Figure 8:
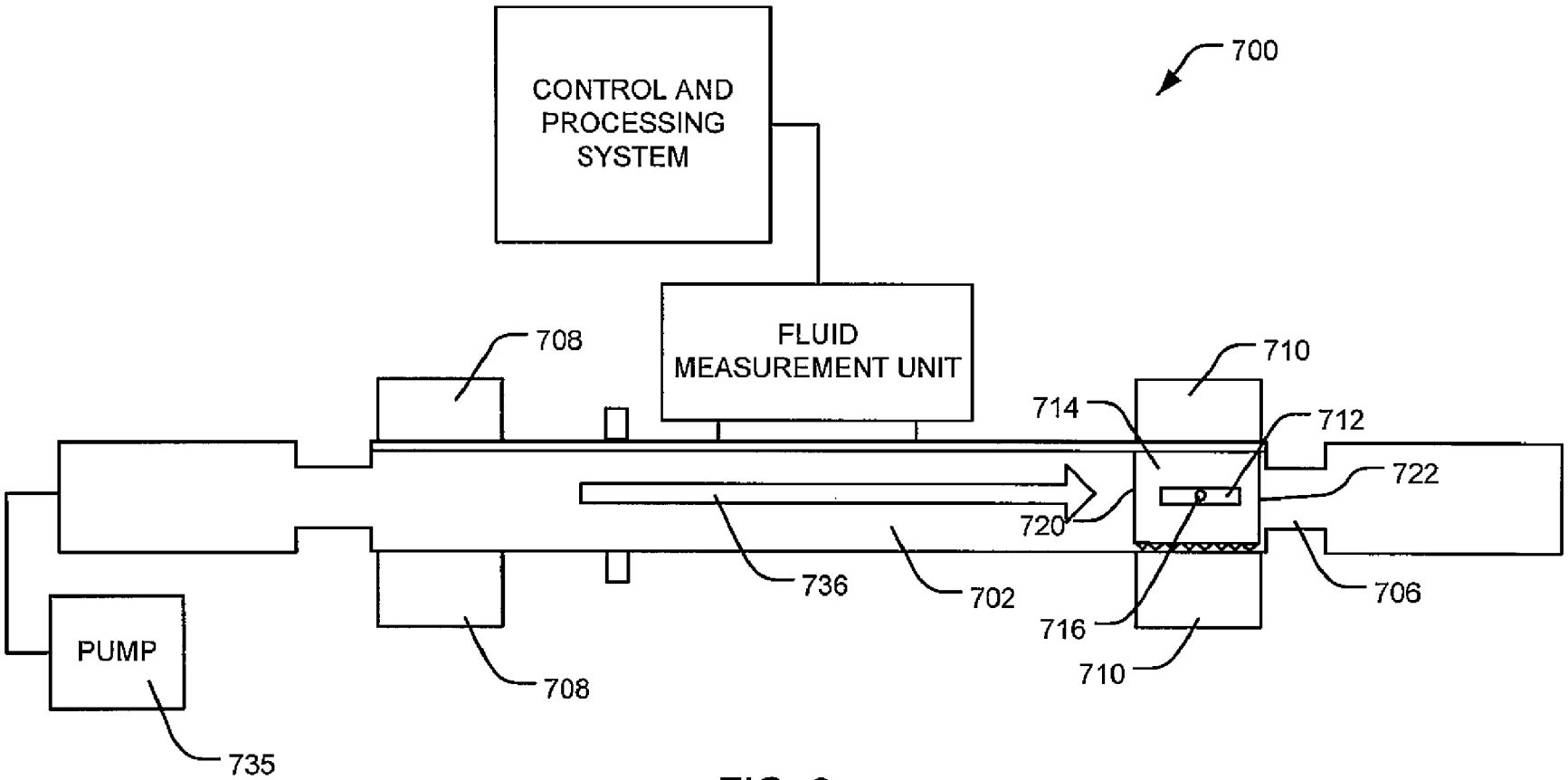
FIG. 8 depicts the example apparatus of FIG. 7 in a deactivated state after cleaning the flowline.

FIGS. 7 and 8 illustrate an example apparatus 700 that may be used to implement a portion of the formation sampling tool 200 associated with the fluid measurement unit 210 and/or the sensors 212 of FIG. 2. The example apparatus 700 includes a flowline 702 that includes a first restriction 704 and a second restriction 706. The first restriction 704 and the second restriction 706 have a smaller diameter and/or cross-section than other portions of the flowline 702 adjacent the first and second restrictions 704 and 706.

The example apparatus 700 is provided with a first electrical coil 708 and a second electrical coil 710. The first electrical coil 708 is positioned adjacent the first restriction 704 on the exterior of the flowline 702 and may at least partially surround the flowline 702. In the example implementation, the first electrical coil 708 may comprise a plurality of electrical coils. Specifically, the first electrical coil 708 may comprise a first coil 709 (e.g., a Helmholtz coil) that is positioned on one side of the flowline 702 and a second coil 711 (e.g., a Helmholtz coil) on an opposite side of the flowline 702. Similarly, the second electrical coil 710 is positioned adjacent the second restriction 706 on the exterior of the flowline 702 and may at least partially surround the flowline 702. In the example implementation, the second electrical coil 710 may also comprise a plurality of electrical coils. Specifically, the second electrical coil 710 may comprise a first coil 713 (e.g., a Helmholtz coil) that is positioned on one side of the flowline 702 and a second coil 715 (e.g., a Helmholtz coil) on an opposite side of the flowline 702. As discussed in more detail below, the coils 709, 711, 713 and 715 may each emit a magnetic field and all or some of the magnetic fields emitted by the coils 709, 711, 713 and 715 may be similar or different from one another. The coils 709, 711, 713 and 715 may produce a substantially uniform magnetic field. Additionally, in other example implementations, the first and second electrical coils 708 and 710 may be implemented using any other suitable electrical coil.

The first and second electrical coils 708 and 710 may be used to generate magnetic fields to actuate and/or rotate a flap or plate 712 of a scraper 714 that includes a magnetic portion 717. Specifically, each of the first and second electrical coils 708 and 710 may be energized to induce the plate 712 to rotate (e.g., pivot) about an axis or pivot point 716 between a closed and/or activated position (e.g., substantially perpendicular to the flowline 702) and an open and/or deactivated position (e.g., substantially parallel to the flowline 702).

The scraper 714 defines a bore 718 that has a first opening 720 and a second opening 722 that enable fluid to flow through the scraper 714. Specifically, the scraper 714 comprises a valve that actuates between an open position that permits the flow of fluid through the scraper 714 and a closed position to substantially obstruct the flow of fluid through the scraper 714 and the flowline 702. An external surface 724 of the scraper 714 has a diameter and/or the scraper 714 has a cross-section that substantially corresponds to a diameter of an inner surface 726 and/or cross-section of the flowline 702 such that the external surface 724 of the scraper 714 at least partially flexibly engages the inner surface 726 of the flowline 702. However, in other example implementations, the flowline 702 and the scraper 714 may have any other suitable corresponding or complementary geometries. The scraper 714 may define a groove 727 that corresponds to a rib 729 that may assist in guiding the scraper 714 within the flowline 702 and may substantially prevent the scraper 714 from rotating within the flowline 702. Additionally, as described in more detail below in connection with FIG. 12, the example apparatus 700 may be provided with the coil 1232 to determine the position and/or direction in which the scraper 714 is moving within the flowline 702.

Figure 9:
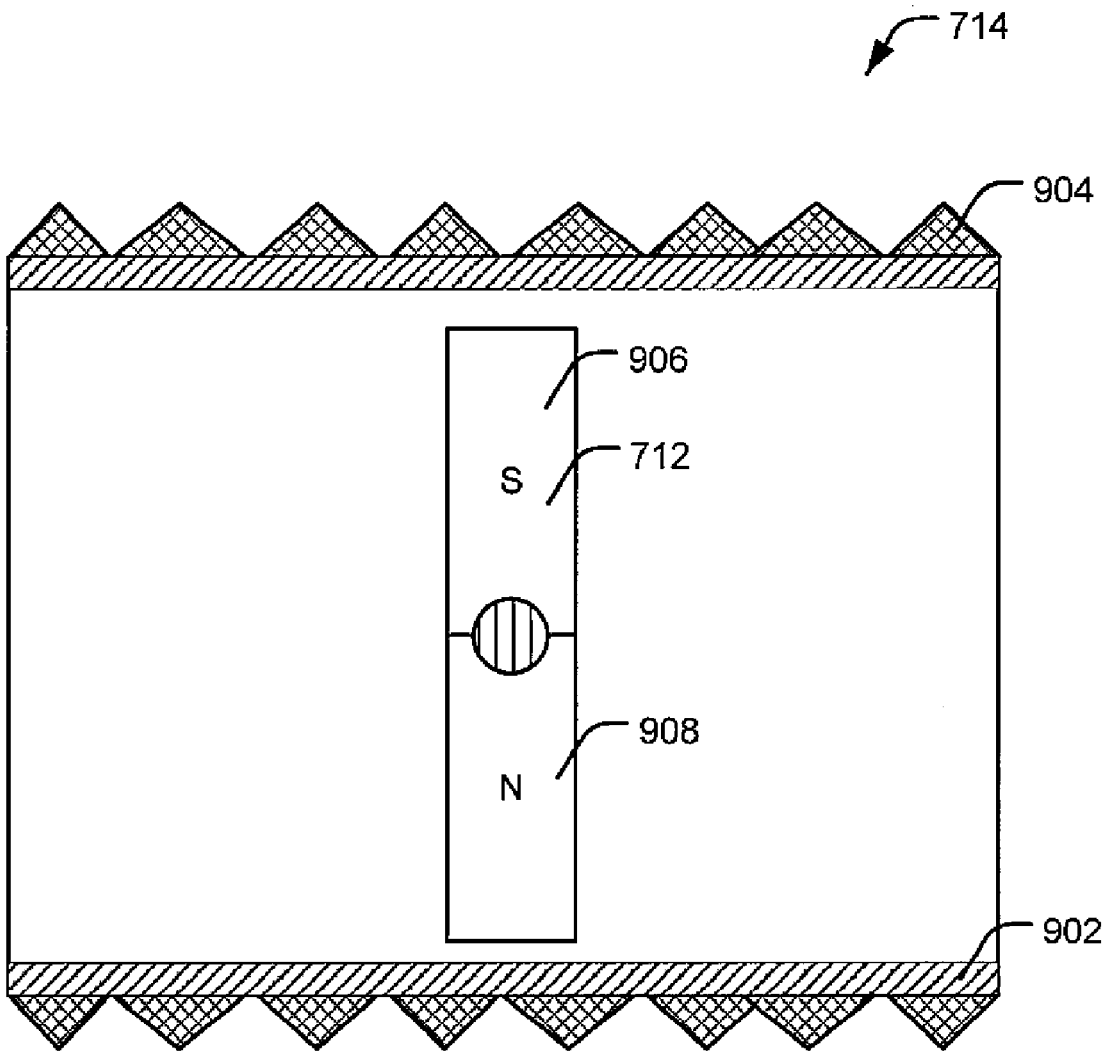
FIG. 9 depicts a more detailed cross-sectional view of the example scraper of FIGS. 7 and 8.

Turning briefly to FIG. 9, the scraper 714 may be made of a single piece of material or a plurality of different materials. In this example implementation, the scraper 714 is substantially cylindrical, however, the scraper 714 may be any other suitable geometry. In some examples, the scraper 714 is provided with an interior portion 902 and an exterior portion 904. The exterior portion 904 may be made of a relatively softer material as compared to the interior portion 902. For example, the exterior portion 904 may be made of a rubber material or any other suitable material that will substantially not damage (e.g., scratch) a window 732 (FIG. 7) of a fluid measurement unit 734 (FIG. 7) as the scraper 714 moves through the flowline 702 (FIG. 7). Specifically, as the scraper 714 moves through the flowline 702 (FIG. 7), the exterior portion 904 rubs, wipes and/or scrapes against the inner surface 726 (FIG. 7) to remove and/or dislodge deposits within the example apparatus 700 (FIG. 7). The interior portion 902 may be made of the same or a different material as the exterior portion 904 such as, for example, a ceramic material, a rubber material, a metal material etc. The plate 712 may include a pressure relief member such as, for example, a membrane section (not shown) and/or a hydraulic fuse (not shown) that may break or release the fluid if exposed to a predetermined amount of fluid pressure or a predetermined pressure differential. The membrane may be made of any suitable material such as, for example, a silicon material, a rubber material, etc. and may have a thickness that withstands a predetermined amount of pressure. For example, if the plate 712 is unable to move from the activated position and the fluid flow is substantially restricted, the membrane may break and enable fluid to flow through the plate 712 even though the plate 712 is in the activated position (e.g., substantially perpendicular to the fluid flow path of the flowline 702). Additionally, the plate 712 is provided with a first magnetic portion 906 and a second magnetic portion 908. In this example implementation, the first magnetic portion 906 has a south magnetic polarity and the second magnetic portion 908 has north magnetic polarity. The first and second magnetic portions 906 and 908 respond to magnetic fields emitted by the first and/or second electrical coils 708 and 710.

Figure 17:
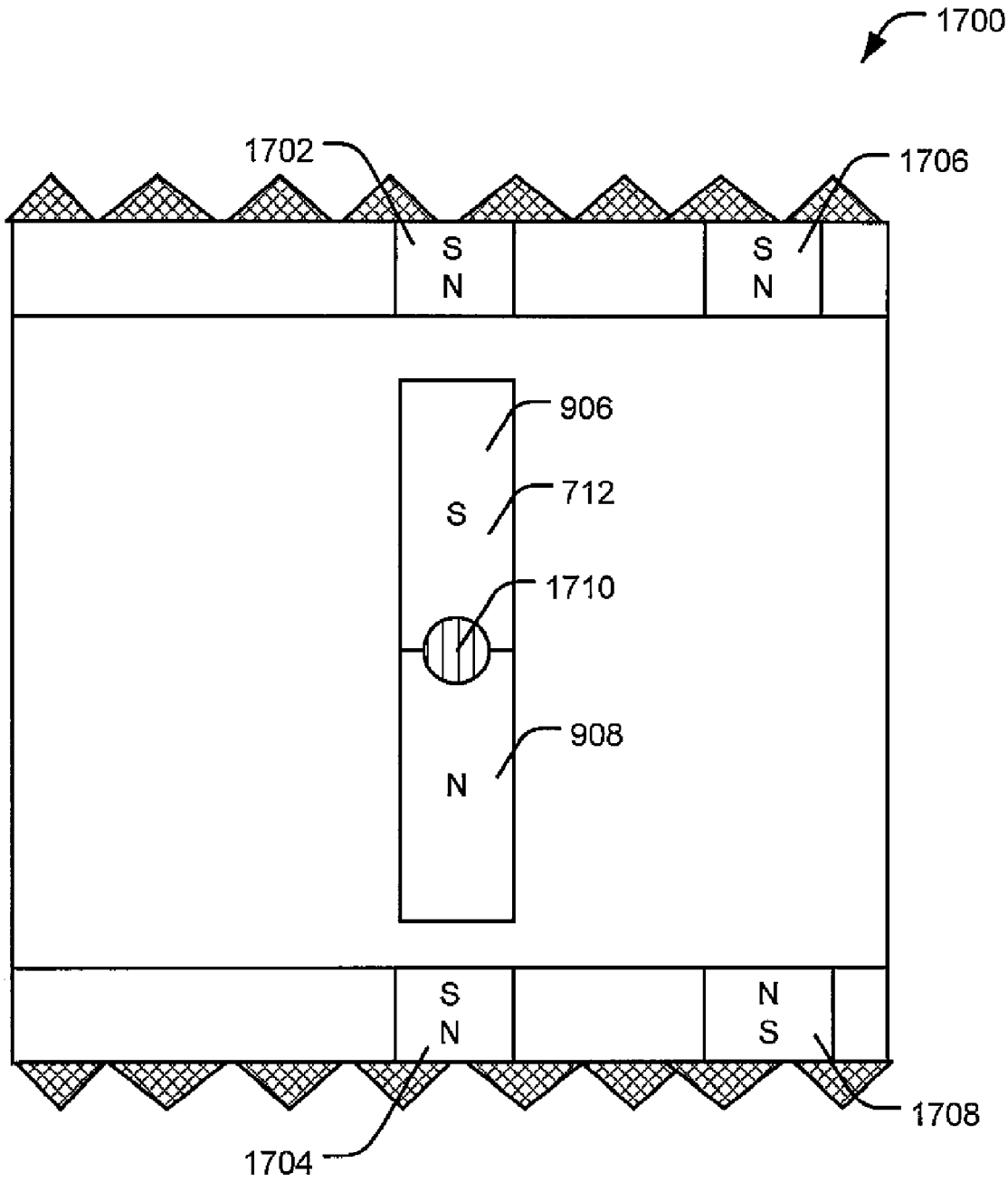
FIG. 17 depicts a detailed cross-sectional view of another example scraper that may be used in conjunction with the example apparatus of FIGS. 7 and 8.

FIG. 17 illustrates another example scraper 1700 that may be used in place of the scraper 714 to implement the example apparatus 700 of FIGS. 7 and 8. The scraper 1700 is provided with a plurality of permanent magnets (e.g., a first magnet 1702, a second magnet 1704, a third magnet 1706 and a fourth magnet 1708). In this example implementation, the first and second magnets 1702 and 1704 are substantially aligned with an axis of rotation 1710 of the plate 712 such that the first and second magnets 1702 and 1704 act against the first and second magnetic portions 906 and 908 if the plate 712 is the activated position. The third and fourth magnets 1706 and 1708 are positioned such that the third and fourth magnets 1706 and 1708 act against the first or second magnetic portion 906 and 908 if the plate 712 is in the deactivated position. In other example implementations, the example scraper 1700 may be provided with an additional set of magnets (e.g., a fifth magnet and a sixth magnet) that are positioned opposite the third and fourth magnets 1706 and 1708. Magnetic fields emitted by the magnets 1702, 1704, 1706 and 1708 act against the first and second magnetic portions 906 and 908 of the plate 712 to assist in maintaining the position of the plate 712 in either the activated position or the deactivated position. The magnetic fields emitted by the magnets 1702, 1704, 1706 and 1708 may be relatively weaker or of a lower intensity than the magnetic fields emitted by the first and second electrical coils 708 and 710 such that the magnetic fields emitted by the first and second electrical coils 708 and 710 overcome the magnetic fields emitted by the magnets 1702, 1704, 1706 and 1708 to move or rotate the plate 712. In practice, the magnets 1702, 1704, 1706 and 1708 assist in preventing the plate 712 from moving while in either the activated position or the deactivated position, and the first and second electrical coils 708 and 710 actuate the plate 712 between the activated position and the deactivated position.

Figure 18:
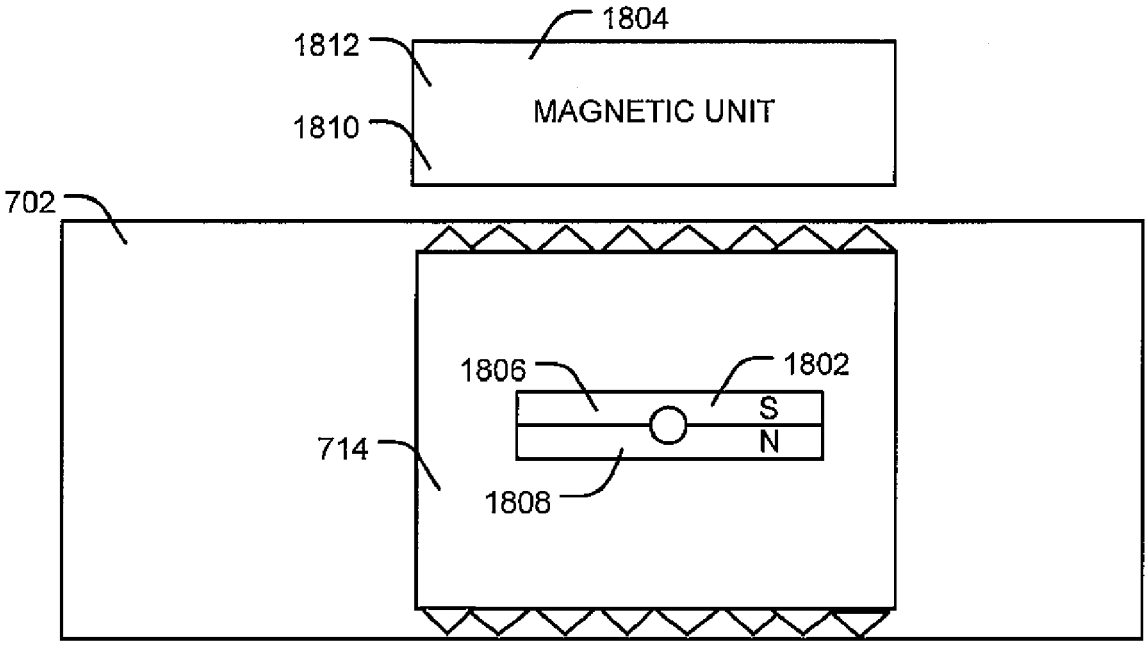
FIG. 18 is a schematic illustration of a portion of an alternative embodiment of the example apparatus of FIGS. 7 and 8.

As depicted in FIG. 18, an alternative plate 1802 of the scraper 714 may be actuated by a single magnetic unit 1804. In some example implementations, the plate 1802 may be prevented from rotating more than 90 degrees between the activated position and the deactivated position to ensure that the plate 1802 does not overshoot the desired position. The plate 1802 is provided with a first magnetic portion 1806 and a second magnetic portion 1808. In this example implementation, the first magnetic portion 1806 has a south magnetic polarity and the second magnetic portion 1980 has north magnetic polarity. The first and second magnetic portions 1806 and 1808 respond to a magnetic field emitted by the magnetic unit 1804.

The magnetic unit 1804 includes a first magnetic pole 1810 that is opposite a second magnetic pole 1812. The first magnetic pole 1810 may change between a north magnetic polarity and a south magnetic polarity and the second magnetic pole 1812 may change between a south magnetic polarity and a north magnetic polarity. For example, in practice, if the first magnetic pole 1810 has a north magnetic polarity, the first magnetic portion 1806, which has a south magnetic polarity, is attracted to the first magnetic pole 1810 and the plate 1802 will actuate to or remain in the deactivated position. Alternatively, if the first magnetic pole 1810 has a south magnetic polarity, the first magnetic portion 1806, which has a south magnetic polarity, is repelled from the first magnetic pole 1810 and the plate 1802 rotates substantially 90 degrees to or remains in the activated position.

Figure 10:
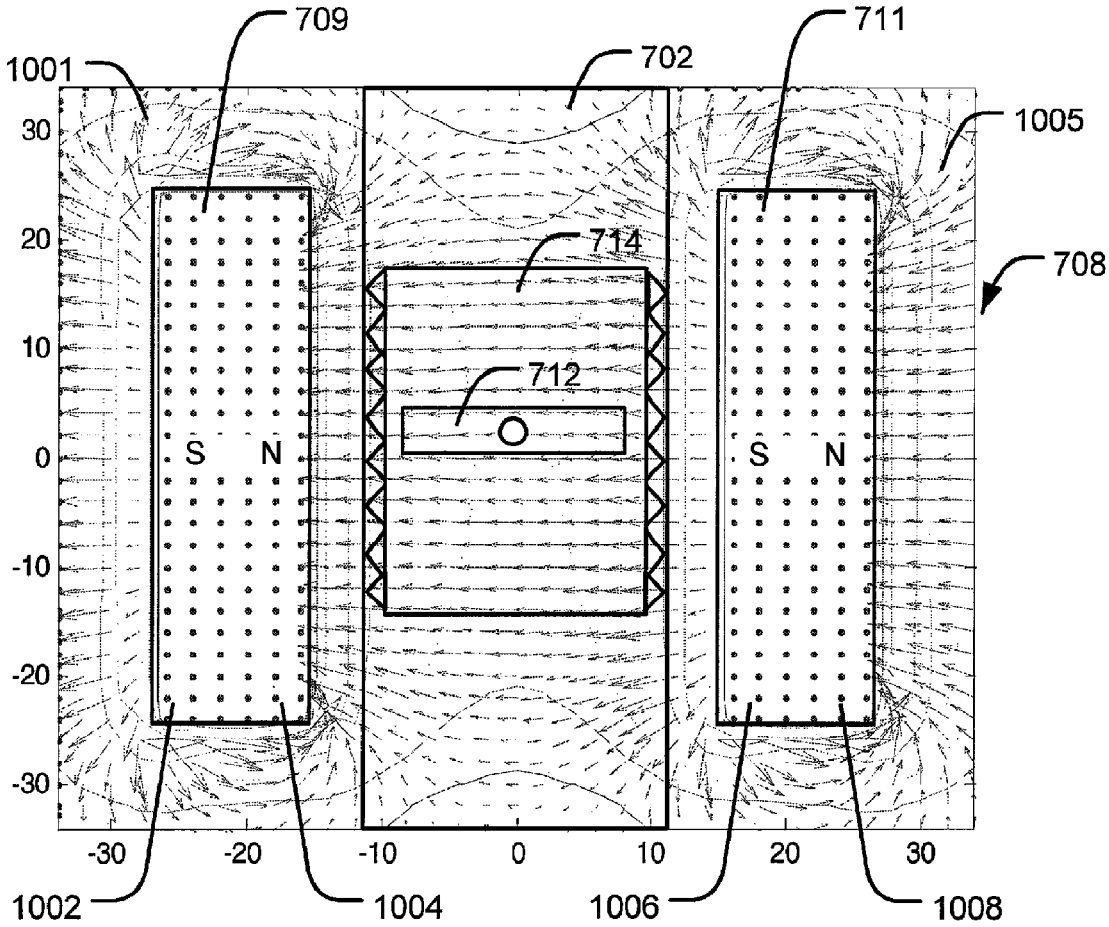
FIG. 10 is a schematic illustration of a portion of the example apparatus illustrated in FIGS. 7 and 8 in the activated state.
Figure 11:
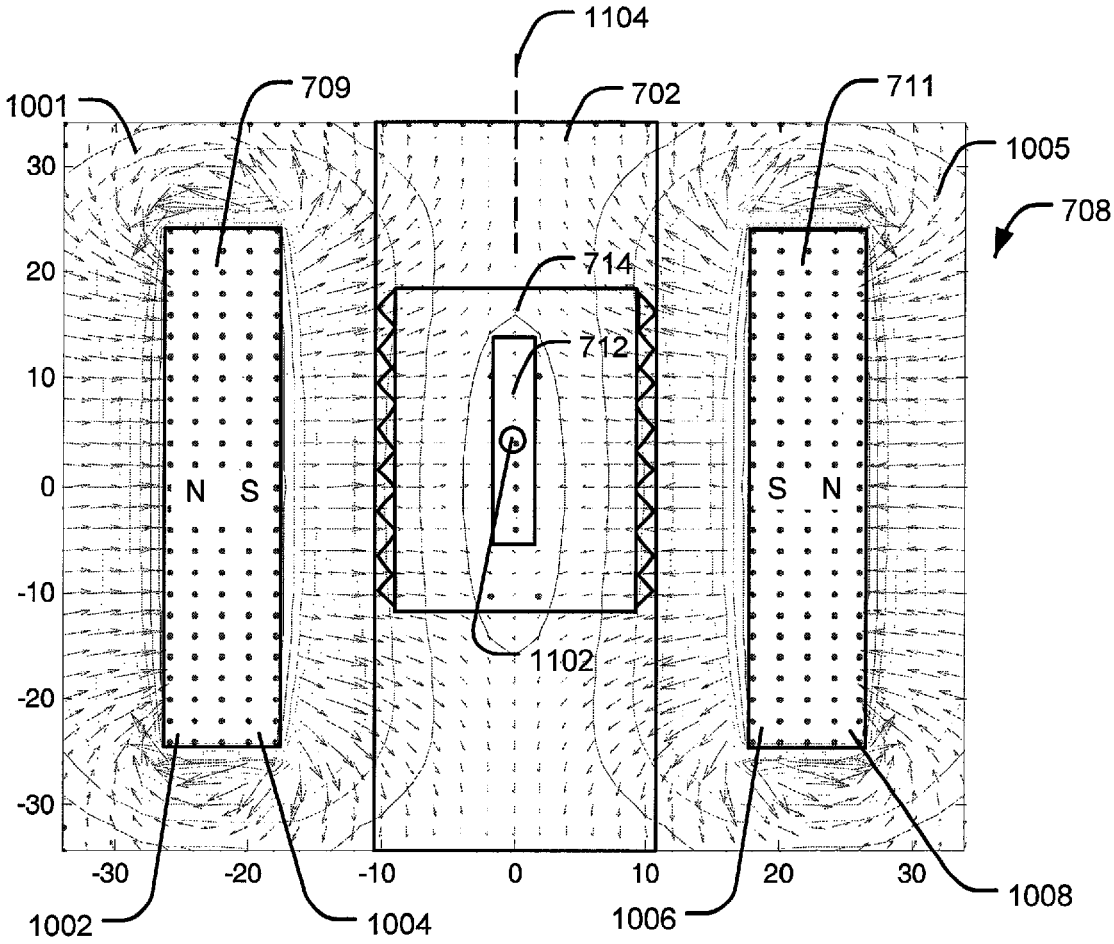
FIG. 11 is a schematic illustration of a portion of the example apparatus illustrated in FIGS. 7 and 8 in the deactivated state.

FIGS. 10 and 11 illustrate a portion of the example apparatus 700 associated with the magnetic field emitted by the first electrical coil 708. FIGS. 10 and 11 illustrate the flowline 702, the first coil 709 and the second coil 711. The first coil 709 at least partially emits a first magnetic field 1001 and includes a first magnetic pole 1002 adjacent a second magnetic pole 1004. The magnetic polarity of the first magnetic pole 1002 is opposite the magnetic polarity of the second magnetic pole 1004. Additionally, the magnetic polarity of the first magnetic pole 1002 may be changed between a north magnetic polarity and a south magnetic polarity and the magnetic polarity of the second magnetic pole 1004 may be changed between a south magnetic polarity and a north magnetic polarity. Similarly, the second coil 711 at least partially emits a second magnetic field 1005 and includes a first magnetic pole 1006 adjacent a second magnetic pole 1008. The magnetic polarity of the first magnetic pole 1006 is opposite the magnetic polarity of the second magnetic pole 1003. Additionally, the magnetic polarity of the first magnetic pole 1006 may be changed between a north magnetic polarity and a south magnetic polarity and the magnetic polarity of the second magnetic pole 1008 may be changed between a north magnetic polarity and a south magnetic polarity. The magnetic field emitted by the first coil 709 may be similar or different from the magnetic field emitted by the second coil 711.

As shown in FIG. 10, the plate 712 of the scraper 714 is in the activated position and the first magnetic poles 1002 and 1006 have a south magnetic polarity and the second magnetic poles 1004 and 1008 have a north magnetic polarity. More generally, the coils 709 and 711 are polarized in substantially the same direction.

Alternatively, as shown in FIG. 11, the plate 712 of the scraper 714 is in the deactivated position and the first magnetic pole 1002 and the second magnetic pole 1008 have a north magnetic polarity and the second magnetic pole 1004 and the first magnetic pole 1006 have a south magnetic polarity. More generally, the coils 709 and 711 are polarized in substantially opposite directions. Additionally, in the deactivated position, the magnetic field at a point 1102 on an axis 1104 of the flowline 702 is substantially zero.

Turning back to FIGS. 7 and 8, the example apparatus 700 includes the fluid measurement unit 734 that is provided with the window 732 that may be used to implement the fluid measurement unit 210 and/or the sensors 212 of FIG. 2. The window 732 is substantially adjacent to and/or flush with the inner surface 726 of the flowline 702. The fluid measurement unit 734 may be any suitable fluid measurement unit and/or sensor such as, for example, a spectrometer, a fluorescence window, a tuning fork, a density sensor (e.g., a vibrating object for density measurement), a viscosity sensor (e.g., a vibrating object for viscosity measurement), a resistivity sensor, an ohmmeter, an X-ray detector, a nuclear magnetic resonance (NMR) sensor, a pH meter, a carbon dioxide meter, a hydrogen sulfide detector, a flow meter, a pressure sensor, a temperature sensor, or an imaging device (e.g., a charge coupled device (CCD)).

In operation, a pump 735 pumps fluid (e.g., formation fluid) through the flowline 702 in a direction generally indicated by arrow 736, and the fluid measurement unit 734 measures various parameters of the fluid such as the composition or a characteristic of a fluid sample. The fluid may include impurities such as, for example, heavy components, precipitated asphaltenes, various minerals, and/or fine particles that may accumulate within the flowline 702 and/or on the window 732, and may bias the measurements obtained by the fluid measurement unit 734. In some examples, a control and processing system 738 compares measurements received from the fluid measurement unit 734 to identify a trend of measurements that may indicate the presence and/or accumulation of deposits within the flowline 702 and/or on the window 732. The control and processing system 738 may be used to implement the processing unit 224 of FIG. 2. In other examples, the control and processing system 738 compares actual measurements to theoretical and/or reference measurements to identify a substantial difference between the actual measurements and the theoretical and/or reference measurements that may indicate the presence and/or accumulation of deposits within the flowline 702 and/or on the window 732. The fluid parameter measurement, comparison, and presence detection operations described herein may be performed periodically (e.g., at a certain time interval) or substantially continuously to suit the needs of a particular application. In other example implementations, the control and processing system 738 may compare measurements received from the fluid measurement 734 with other measurements received from other fluid measurement units 210 (FIG. 2) or sensors 212 (FIG. 2) within the formation sampling tool 200 (FIG. 2) to identify a substantial difference between the measurements received. A substantial difference between these received measurements may indicate the presence and/or accumulation of deposits within the flowline 702 and/or on the window 732.

If a predetermined time has expired, a predetermined number of measurements have been obtained by the fluid measurement unit 734 and/or if it is determined that there are deposits on the window 732 and/or in the flowline 702, the first electrical coil 708 activates (e.g., actuates) the plate 712 to be substantially perpendicular to the flow of fluid (e.g., as shown in FIG. 10). Once the plate 712 is in the activated position, the plate 712 at least partially obstructs the fluid flow and the fluid moves the scraper 714 from a first position adjacent the first restriction 704 through the flowline 702 to a second position adjacent the second restriction 706. As the scraper 714 moves through the flowline 702, the external surface 724 at least partially slidably engages the inner surface 726 of the flowline 702 to remove deposits (or a portion thereof) within the flowline 702 and/or on the window 732. The first and second restrictions 704 and 706 are substantially smaller (e.g., in diameter, cross-sectional area, etc.) than the external diameter of the scraper 714 and, thus, the first and second restrictions 704 and 706 substantially restrict the movement of the scraper 714 to be between the first and second restrictions 704 and 706. After the scraper 714 is in the second position, the second electrical coil 710 deactivates the plate 712 by emitting an opposite magnetic field (e.g., as shown in FIG. 11), which moves the plate 712 to be substantially parallel to the flow of fluid. In the deactivated position, fluid flows through the scraper 714. To move the scraper 714 from the second position back to the first position, the pump 735 reverses the flow of fluid through the flowline 702 (i.e., a flow direction opposite arrow 736) and the process is repeated as described above, but the second electrical coil 710 activates the plate 712 and the first electrical coil 708 deactivates the plate 712.

Figure 12:
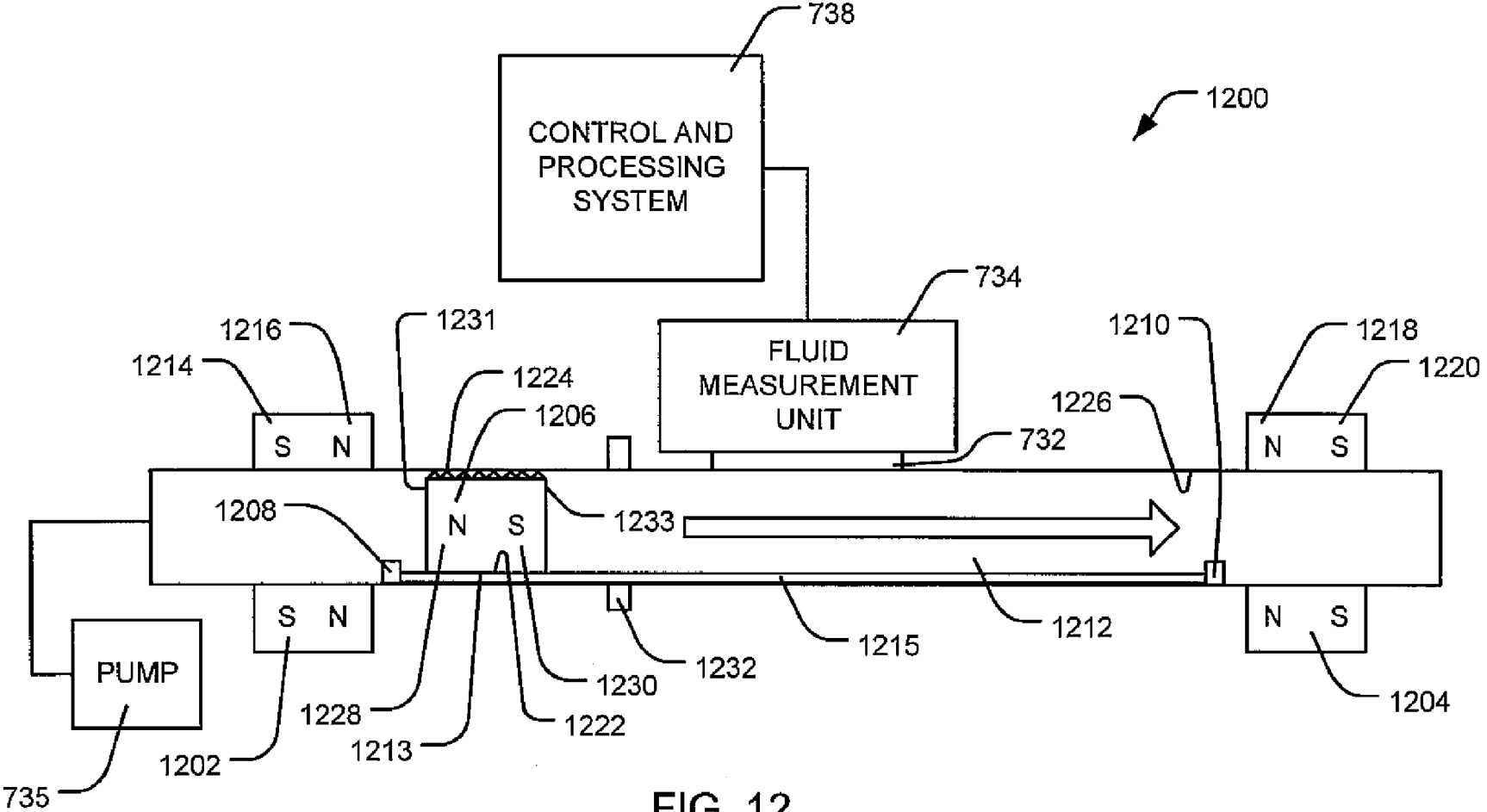
FIG. 12 is a schematic illustration of another example apparatus that may be used to implement or in conjunction with the fluid measurement unit of FIG. 2.

Turning to FIG. 12, an example apparatus 1200 is depicted that may be used to implement a portion of the formation sampling tool 200 associated with the fluid measurement unit 210 and/or the sensors 212 of FIG. 2. The example apparatus 1200 is provided with a first magnetic unit 1202 and a second magnetic unit 1204 that may move a scraper 1206 between a first position and a second position. The first position is adjacent a first restriction 1208 and the second position is adjacent a second restriction 1210. The first and second restrictions 1208 and 1210 substantially restrict the movement of the scraper 1206 within a portion of a flowline 1212. Additionally, the position of the first and second restrictions 1208 and 1210 relative to the first and second magnetic units 1202 and 1204 enable the movement of the scraper 1206 within the flowline 1212. Specifically, the position of the first and second restrictions 1208 and 1210 ensures that the scraper 1206 will be repelled and/or attracted by the respective magnetic unit 1202 and 1204. In other example implementations, the flowline 1212 may include any other suitable structure that may partially protrude into the flow of fluid to restrict the movement of the scraper 1206. The first and second magnetic units 1202 and 1204 may be any suitable magnetic unit such as, for example, a DC electromagnetic unit and may be substantially coaxial with the flowline 1212. Additionally, the first and second magnetic units 1202 and 1204 may at least partially surround the flowline 1212. Additionally, the scraper 1206 may define a groove 1213 that corresponds to a rib 1215 that may assist in guiding the scraper 1206 within the flowline 1212 and may substantially prevent the scraper 1206 from rotating within the flowline 1212.

The first magnetic unit 1202 includes a first magnetic pole 1214 adjacent a second magnetic pole 1216. The magnetic polarity of the first magnetic pole 1214 is opposite the magnetic polarity of the second magnetic pole 1216. Additionally, the magnetic polarity of the first magnetic pole 1214 may be changed between a north magnetic polarity and a south magnetic polarity and the magnetic polarity of the second magnetic pole 1216 may be changed between a south magnetic polarity and a north magnetic polarity. Similarly, the second magnetic unit 1204 includes a first magnetic pole 1218 adjacent a second magnetic pole 1220. The magnetic polarity of the first magnetic pole 1218 is opposite the magnetic polarity of the second magnetic pole 1220. Additionally, the magnetic polarity of the first magnetic pole 1218 may be changed between a north magnetic polarity and a south magnetic polarity and the magnetic polarity of the second magnetic pole 1220 may be changed between a north magnetic polarity and a south magnetic polarity. The magnetic polarity of the first magnetic poles 1214 and 1218 may be the same or different and the magnetic polarity of the second magnetic poles 1216 and 1220 may be the same or different. However, typically, the magnetic polarity of the first magnetic pole 1214 is opposite the magnetic polarity of the first magnetic pole 1218 and the magnetic polarity of the second magnetic pole 1216 is opposite the magnetic polarity of the second magnetic pole 1220 such that the scraper 1206 is attracted to or repelled from the respective magnetic poles 1214, 1216, 1218 and 1220.

In this example, the scraper 1206 defines an aperture 1222 that enables fluid to flow through the scraper 1206. An external surface 1224 of the scraper 1206 has a diameter and/or the scraper 1206 has a cross-section that substantially corresponds to a diameter of an inner surface 1226 and/or cross-section of the flowline 1212 such that the external surface 1224 slidably engages the inner surface 1226 of the flowline 1212 to remove and/or dislodge deposits in the flowline 1212 and/or on the window 732 as described above. In other example implementations, the flowline 1212 and the scraper 1206 may have any other suitable corresponding or complementary geometries. The scraper 1206 is provided with a first magnetic portion 1228 and a second magnetic portion 1230 having poles that are substantially aligned along the longitudinal axis of the flowline 1212. The magnetic portions 1228 and 1230 may be implemented using a permanent magnet. Regardless of the implementation, the first and second magnetic portions 1228 and 1230 respond to a magnetic field emitted by the first and/or second magnetic units 1202 and 1204. Additionally, the flow of fluid through the flowline 1212 may engage either a first face 1231 or a second face 1233 of the scraper 1206 to assist in moving the scraper 1206 through the flowline 1212. The first and second faces 1231 and 1233 are substantially perpendicular to the flow of fluid and are on opposite sides of the scraper 1206. The first and second faces 1231 and 1233 are between the aperture 1222 and the external surface 1224.

The first magnetic unit 1202 and the second magnetic unit 1204 may create a magnetic field that moves the scraper 1206 between the first position and the second position. For example, if the first magnetic portion 1228 of the scraper 1206 has a north magnetic polarity and the second magnetic portion 1230 of the scraper 1206 has a south magnetic polarity, to move the scraper 1206 from the first position to the second position, the first magnetic unit 1202 may repel the scraper 1206 and the second magnetic unit 1204 may attract the scraper 1206. Specifically, the first magnetic pole 1214 may have a south magnetic polarity and the second magnetic pole 1216 may have a north magnetic polarity. In contrast, the first magnetic pole 1218 may have a north magnetic polarity and the second magnetic pole 1220 may have a south magnetic polarity. To move the scraper 1206 from the second position back to the first position, the polarity of the first and second magnetic units 1202 and 1204 is reversed. If the first and second magnetic units 1202 and 1204 are electromagnets, the polarity of the magnetic field is associated with a direction that a current flows through the respective first and second magnetic units 1202 and 1204. As a result, changing the direction in which the current flows through the first and second magnetic units 1202 and 1204 also changes the polarity of the magnetic field such as, for example, the north magnetic pole would change to the south magnetic pole and the south magnetic pole would change to the north magnetic pole. For example, the first magnetic pole 1214 may have a north magnetic polarity and the second magnetic pole 1216 may have a south magnetic polarity, and the first magnetic pole 1218 may have a south magnetic polarity and the second magnetic pole 1220 may have a north magnetic polarity. In other example implementations, the first and second magnetic units 1202 and 1204 may be implemented using permanent magnets that are mechanically rotatable between a first position and a second position. The first and second positions align the magnetic poles along the longitudinal axis of the flowline 1212. Specifically, mechanically rotating the permanent magnets changes the position of the north magnetic pole and the south magnetic pole relative to the scraper 1206 and, thus, the scraper 1206 responds to magnetic field emitted by the respective magnetic units 1202 and 1204 by moving through the flowline 1212.

The example apparatus 1200 may be provided with the coil 1232 to determine the position and/or direction in which the scraper 1206 is moving within the flowline 1212. In some examples, the coil 1232 may detect a variation in a magnetic field emitted by the scraper 1206 to determine the position of the scraper 1206 if the scraper 1206 is moving within the flowline 1212. Specifically, the movement of the scraper 1206 changes the magnetic field and induces a current in the coil 1232. The position of the scraper 1206 within the flowline 1212 may be communicated to the control and processing system 738 and may be used to determine if the polarity of the first and second magnetic units 1202 and 1204 must be reversed to move the scraper 1206 within the flowline 1212. For example, if the coil 1232 identifies movement of the scraper 1206 adjacent the first position, to move the scraper 1206 to the second position, the second magnetic pole 1216 of the first magnetic unit 1202 has a polarity that repels the first magnetic portion 1228 of the scraper 1206 and the first magnetic pole 1218 of the second magnetic unit 1204 has a polarity that attracts the second magnetic portion 1230 of the scraper 1206. Alternatively, if the coil 1232 identifies movement of the scraper 1206 adjacent the second position, to move the scraper 1206 back to the first position, the first magnetic pole 1218 of the second magnetic unit 1204 has a polarity that repels the second magnetic portion 1230 of the scraper 1206 and the second magnetic pole 1216 of the first magnetic unit 1202 has a polarity that attracts the first magnetic portion 1228 of the scraper 1206.

In some example implementations, the magnetic field emitted by the first and second magnetic units 1202 and 1204 may be substantially constant. However, in other example implementations, the magnetic field emitted by the first and second magnetic units 1202 and 1204 may vary depending on the position of the scraper 1206 relative to the first and/or second magnetic units 1202 and 1204. If the first and second magnetic units 1202 and 1204 are electromagnets, the magnitude of the magnetic fields emitted are associated with the magnitude of a current flowing through the first and second magnetic units 1202 and 1204. As a result, if the magnitude of the current is relatively large, the magnitude of the magnetic field will also be relatively large. Alternatively, if the magnitude of the current is relatively small, the magnitude of the magnetic field will also be relatively small. The closer the scraper 1206 is to the first magnetic unit 1202 or the second magnetic unit 1204, the larger the magnitude of the magnetic field that may be emitted by the respective magnetic unit 1202 and 1204. Alternatively, the further the scraper 1206 is to the first magnetic unit 1202 or the second magnetic unit 1204, the smaller the magnitude of the magnetic field that may be emitted by the respective magnetic unit 1202 and 1204. As described above, the position of the scraper 1206 within the flowline 1212 and relative to the first and/or second magnetic units 1202 and 1204 may be determined by the coil 1232.

Figure 13:
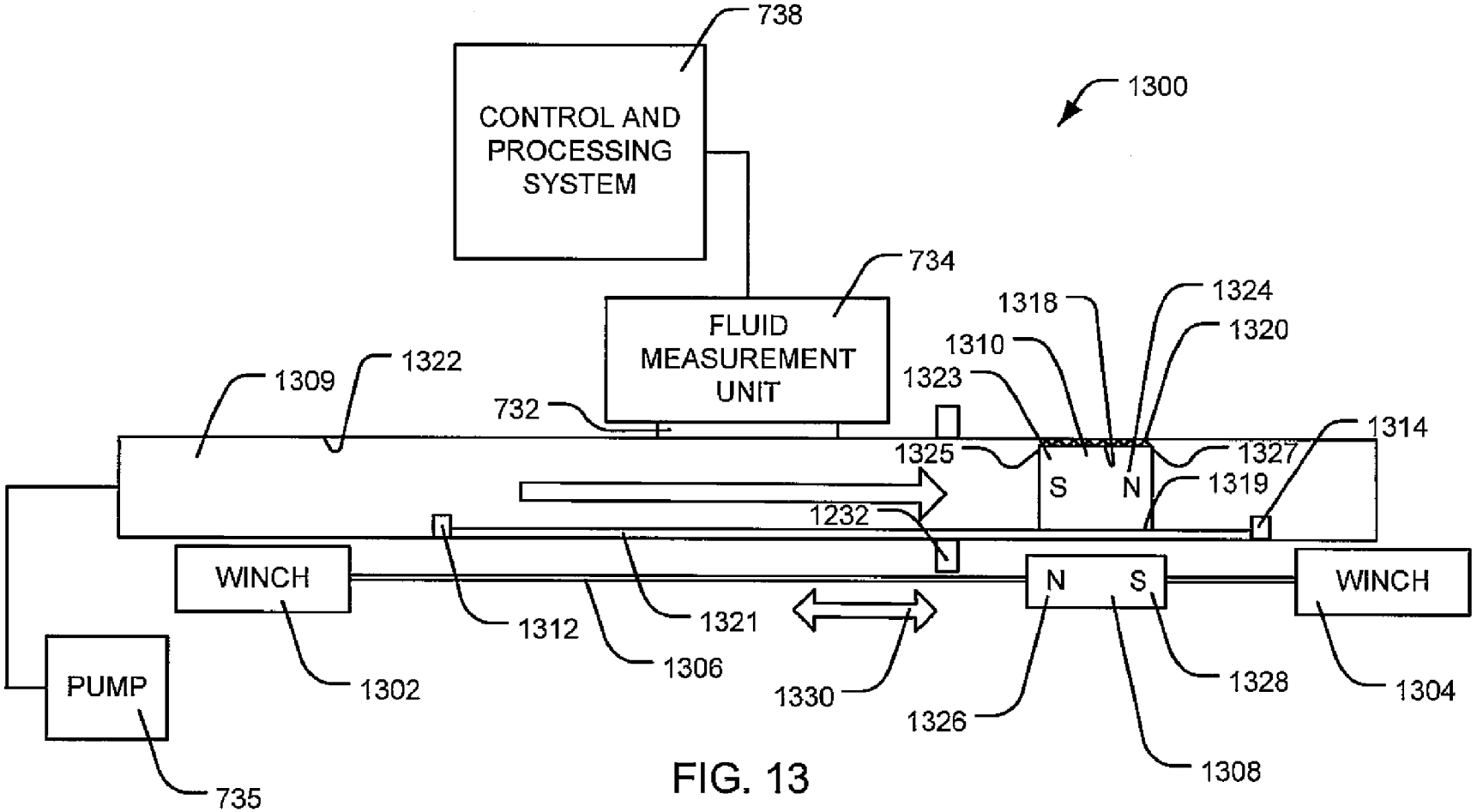
FIG. 13 is a schematic illustration of another example apparatus that may be used to implement or in conjunction with the fluid measurement unit of FIG. 2.

Turning to FIG. 13, an example apparatus 1300 is depicted that may be used to implement a portion of the formation sampling tool 200 associated with the fluid measurement unit 210 and/or the sensors 212 of FIG. 2. The example apparatus 1300 is provided with a first winch 1302 and a second winch 1304. A cable or track 1306 is positioned between and coupled to the first and second winches 1302 and 1304 and an electrical coil or magnet 1308 is coupled to the track 1306. The first and/or second winches 1302 and 1304 may move and/or turn to move the track 1306 and the magnet 1308 relative to a flowline 1309. The magnet 1308 emits a magnetic field to move a scraper 1310 between a first position and a second position within the flowline 1309. The first position is adjacent a first restriction 1312 and the second position is adjacent a second restriction 1314. The first and second restrictions 1312 and 1314 substantially restrict the movement of the scraper 1310 within a portion of the flowline 1309. In other example implementations, the flowline 1309 may include any other suitable structure that may partially protrude into the flow of fluid to restrict the movement of the scraper 1310. Additionally, in other example implementations, the example apparatus 1300 may be provided with any other suitable means to move the magnet 1308 relative to the flowline 1309 such as, for example, the example apparatus 1300 may be provided with a movable arm. Additionally, as described above in connection with FIG. 12, the example apparatus 1300 may be provided with the coil 1232 to determine the position and/or direction in which the scraper 1310 is moving within the flowline 1309.

In this example, the scraper 1310 defines an aperture 1318 that enables fluid to flow through the scraper 1310. An external surface 1320 of the scraper 1310 has a diameter and/or the scraper 1310 has a cross-section that substantially corresponds to a diameter of an inner surface 1322 and/or cross-section of the flowline 1309 such that the external surface 1320 slidably engages the inner surface 1322 of the flowline 1309 to remove and/or dislodge deposits in the flowline 1309 and/or on the window 732 as described above. In other example implementations, the flowline 1309 and the scraper 1310 may have any other suitable corresponding or complementary geometries. Additionally, the scraper 1310 may define a groove 1319 that corresponds to a rib 1321 that may assist in guiding the scraper 1310 within the flowline 1309 and may substantially prevent the scraper 1310 from rotating within the flowline 1309.

The scraper 1310 may include a magnet or magnetic portion that may be attracted to or respond to the magnetic field emitted by the magnet 1308. Alternatively, the scraper 1310 may be at least partially made of a magnetic material and/or a metal material that is attracted to or responds to the magnetic field emitted by the magnet 1308. In this example implementation, the scraper 1310 includes a first magnetic portion 1323 and a second magnetic portion 1324 having magnetic poles that are aligned along the longitudinal axis of the flowline 1309. Additionally, the flow of fluid through the flowline 1309 may engage either a first face 1325 or a second face 1327 of the scraper 1310 to assist in moving the scraper 1310 through the flowline 1309. The first and second faces 1325 and 1327 are substantially perpendicular to the flow of fluid and are on opposite sides of the scraper 1310. The first and second faces 1325 and 1327 are between the aperture 1318 and the external surface 1320.

The magnet 1308 includes a first magnetic pole 1326 adjacent a second magnetic pole 1328. The magnetic polarity of the first magnetic pole 1326 is opposite the magnetic polarity of the second magnetic pole 1328. The magnetic polarity of the first magnetic pole 1326 of the magnet 1308 may be opposite the magnetic polarity of the first magnetic portion 1323 of the scraper 1310 such that the first magnetic pole 1326 is attracted to the first magnetic portion 1323. Additionally, the magnetic polarity of the second magnetic pole 1328 of the magnet 1308 may be opposite the magnetic polarity of the second magnetic portion 1324 of the scraper 1310 such that the second magnetic pole 1328 is attracted to the second magnetic portion 1324.

For example, to move the scraper 1310 from the first position to the second position, the first and/or second winches 1302 and 1304 may move the track 1306 along with the magnet 1308 adjacent the flowline 1309 in a direction generally indicated by arrow 1330. As the magnet 1308 moves, the magnetic field emitted by the magnet 1308 also moves and, as a result, the scraper 1310 moves adjacent the magnet 1308 within the flowline 1309. To move the scraper 1310 from the second position back to the first position, the first and second winches 1302 and 1304 move the track 1306 along with the magnet 1308 back to the first position as described above.

Figure 14:
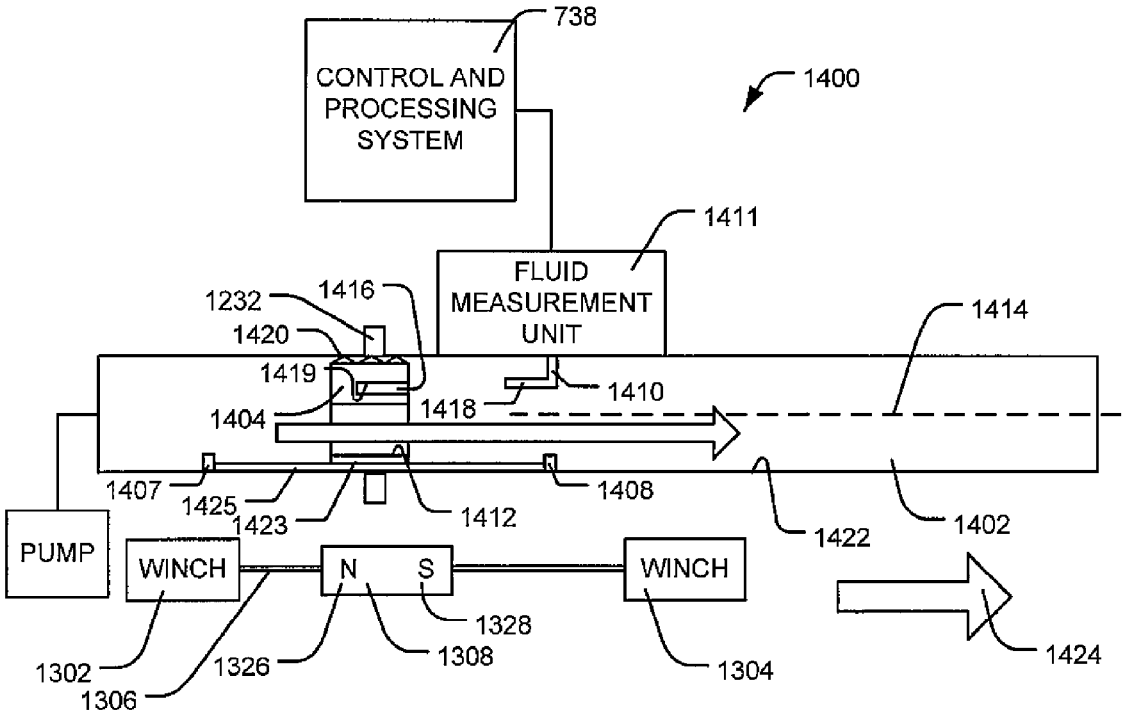
FIG. 14 is a schematic illustration of another example apparatus that may be used to implement or in conjunction with the fluid measurement unit of FIG. 2 showing the scraper is in a first position.

Turning to FIG. 14, an example apparatus 1400 is depicted that may be used to implement a portion of the formation sampling tool 200 associated with the fluid measurement unit 210 and/or the sensors 212 of FIG. 2. Reference numbers in FIG. 14 that are the same as those used in FIG. 13 correspond to structures that are similar or identical to those described in connection with FIG. 13. The example apparatus 1400 is provided with the first and second winches 1302 and 1304 and the cable or track 1306 that is coupled to the electrical coil or magnet 1308. The first and second winches 1302 and 1304 may mechanically, pneumatically or hydraulically move the track 1306 and the magnet 1308 relative to a flowline 1402. Additionally, as the magnet 1308 moves, a scraper 1404 moves adjacent the magnet 1308 between a first position and a second position within the flowline 1402. Specifically, the scraper 1404 includes a magnet or a magnetic portion that responds to the magnetic field emitted by the magnet 1308. In other example implementations, the example apparatus 1400 may be provided with any other suitable means, such as the methods and apparatus described herein, to move the scraper 1404 within the flowline 1402.

The first position is adjacent a first restriction 1407 and the second position is adjacent a second restriction 1408. The first and second restrictions 1407 and 1408 substantially restrict the movement of the scraper 1404 within a portion of the flowline 1402 and the second restriction 1408 substantially prevents the scraper 1404 from damaging a sensor 1410 of a fluid measurement unit 1411 that at least partially protrudes into the flowline 1402. The fluid measurement unit 1411 may be used to implement the fluid measurement unit 210 and/or the sensors 212 of FIG. 2. Additionally, the fluid measurement unit 1411 may be substantially similar to the fluid measurement unit 734 (FIG. 7). However, the fluid measurement unit 1411 is provided with the sensor 1410 and may not include the window 732 (FIG. 7).

In this example, the scraper 1404 defines an aperture 1412 that enables fluid to flow through the scraper 1404. The aperture 1412 may be slightly offset relative to an axis 1414 of the flowline 1402. Additionally, the scraper 1404 defines a recess 1416 that corresponds to a portion 1418 of the sensor 1410. Specifically, as the scraper 1404 moves to the second position, the recess 1416 may engage and/or partially surround the portion 1418 of the sensor 1410 to remove and/or dislodge deposits on the portion 1418. A surface 1419 of the recess 1416 may include a coating or may be made of a material such as, for example, a soft rubber material, that does not damage or scratch the portion 1418 of the sensor 1410 if the recess 1416 engages the portion 1418. The recess 1416 and/or the portion 1418 may have any suitable corresponding or complementary geometries.

The flow of fluid through the flowline 1402 may engage either a first face 1502 (FIG. 15) or a second face 1504 (FIG. 15) of the scraper 1404 to assist in moving the scraper 1404 through the flowline 1402. The first and second faces 1502 and 1504 (FIG. 15) are substantially perpendicular to the flow of fluid and are on opposite sides of the scraper 1404.

An external surface 1420 of the scraper 1404 has a diameter and/or the scraper 1404 has a cross-section that substantially corresponds to a diameter of an inner surface 1422 and/or cross-section of the flowline 1402 such that the external surface 1420 slidably engages the inner surface 1422 of the flowline 1402 to remove and/or dislodge deposits in the flowline 1402 as described above. In other example implementations, the flowline 1402 and the scraper 1404 may have any other suitable corresponding or complementary geometries. However, in some example implementations, the external surface 1420 may have a different geometry from the inner surface 1422 and/or the external surface 1420 may not substantially engage the inner surface 1422. Additionally, the scraper 1404 defines a groove 1423 that corresponds to a rib 1425 that may assist in aligning the recess 1416 to the portion 1418 of the sensor 1410. Specifically, the interaction between the groove 1423 and the rib 1425 may substantially prevent the scraper 1404 from rotating within the flowline 1402. However, in other example implementations, the example apparatus 1400 may be provided with any other suitable means to assist in aligning the recess 1416 and the sensor 1410. Additionally, as described above in connection with FIG. 12, the example apparatus 1400 may be provided with the coil 1232 to determine the position and/or direction in which the scraper 1404 is moving within the flowline 1402.

Figure 15:
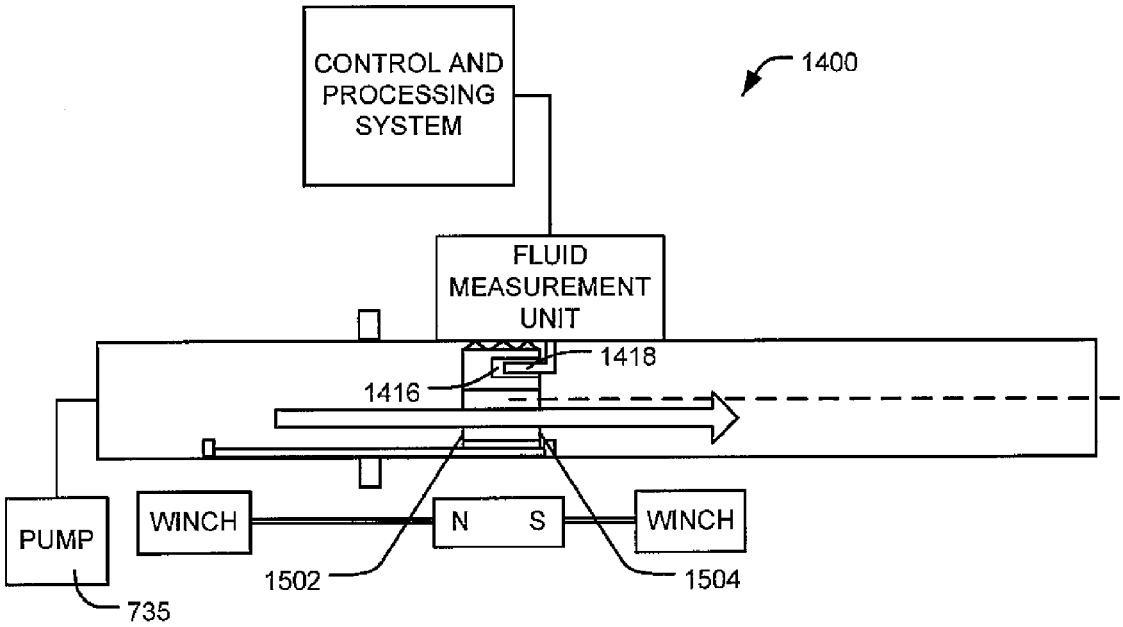
FIG. 15 is a schematic illustration of the example apparatus of FIG. 14 showing the scraper is in a second position.

For example, to move the scraper 1404 from the first position to the second position, the first and second winches 1302 and 1304 move the magnet 1308 relative to the flowline 1402 in a direction generally indicated by arrow 1424. As discussed above, as the magnet 1308 moves, the scraper 1404 moves adjacent the magnet 1308 between the first and second restrictions 1407 and 1408 within the flowline 1402. FIG. 15 illustrates the scraper 1404 in the second position in which the portion 1418 of the sensor 1410 is at least partially positioned within the recess 1416. To move the scraper 1404 from the second position back to the first position, the first and second winches 1302 and 1304 move the magnet 1308 and, thus, the scraper 1404 back to the first position as described above.

FIG. 16 is a schematic diagram of an example processor platform P100 that may be used and/or programmed to implement to implement the electronics and processing system 106, the processing unit 224, the fluid measurement units 330 and 734, and the control and processing systems 340 and 738. For example, the processor platform P100 can be implemented by one or more general purpose processors, processor cores, microcontrollers, etc.

The processor platform P100 of the example of FIG. 16 includes at least one general purpose programmable processor P105. The processor P105 executes coded instructions P110 and/or P112 present in main memory of the processor P105 (e.g., within a RAM P115 and/or a ROM P120). The processor P105 may be any type of processing unit, such as a processor core, a processor and/or a microcontroller. The processor P105 may execute, among other things, the example methods and apparatus described herein.

The processor P105 is in communication with the main memory (including a ROM P120 and/or the RAM P115) via a bus P125. The RAM P115 may be implemented by dynamic random-access memory (DRAM), synchronous dynamic random-access memory (SDRAM), and/or any other type of RAM device, and ROM may be implemented by flash memory and/or any other desired type of memory device. Access to the memory P115 and the memory P120 may be controlled by a memory controller (not shown).

The processor platform P100 also includes an interface circuit P130. The interface circuit P130 may be implemented by any type of interface standard, such as an external memory interface, serial port, general purpose input/output, etc. One or more input devices P135 and one or more output devices P140 are connected to the interface circuit P130.

Although certain example methods, apparatus and articles of manufacture have been described herein, the scope of coverage of this patent is not limited thereto. On the contrary, this patent covers all methods, apparatus and articles of manufacture fairly falling within the scope of the appended claims either literally or under the doctrine of equivalents.

What is claimed is:

1. An apparatus to remove a deposit on an inner surface of a flowline in a downhole tool, comprising:

a movable scraper disposed in a flowline of a downhole tool, wherein the movable scraper is configured to selectively obstruct the flowline so that a fluid flowing in the flowline moves the movable scraper in the flowline, and wherein the movable scraper has an outer surface configured to engage an inner surface of the flowline so that movement of the outer surface along the inner surface removes a deposit on at least a portion of the inner surface; and wherein the flowline directs fluid to a downhole fluid measurement unit.

2. The apparatus as defined in claim 1, wherein the movable scraper comprises a pressure relief member that obstructs the fluid flowing in the flowline to move the scraper, and wherein the pressure relief member opens or breaks in response to an increase in fluid pressure in the flowline to substantially decrease an obstruction in the flowline provided by the movable scraper.

3. The apparatus as defined in claim 2, wherein a pressure at which the pressure relief member opens or breaks is sufficient to cause a transient fluid flow in the flowline to further remove the deposit.

4. The apparatus as defined in claim 2, wherein the flowline comprises a restricted portion to cause the increase in fluid pressure in the flowline to open or break the pressure relief member.

5. The apparatus as defined in claim 2, wherein the pressure relief member comprises a membrane or a hydraulic fuse.

6. The apparatus as defined in claim 1, wherein the scraper comprises a magnetic portion to enable movement of the scraper in the flowline in response to a magnetic field external to the flowline.

7. The apparatus as defined in claim 1, further comprising a storage location to hold the movable scraper out of a flow path of fluid in the flowline.

8. The apparatus as defined in claim 7, wherein the storage location is not in-line with the flow path of the fluid in the flowline.

9. The apparatus as defined in claim 7, further comprising an actuator adjacent the storage location to dispose the movable scraper in the flow path of the fluid in the flowline.

10. The apparatus as defined in claim 9, wherein the actuator is hydraulically, pneumatically, or mechanically operated.

11. The apparatus as defined in claim 1, wherein the movable scraper comprises a valve to obstruct the fluid flowing in the flowline to move the scraper, and wherein the valve opens to substantially decrease an obstruction in the flowline provided by the movable scraper.

12. The apparatus as defined in claim 11, wherein the valve is magnetically operated.

13. The apparatus as defined in claim 12, further comprising at least one coil external to the flowline to magnetically operate the valve.

14. The apparatus as defined in claim 11, wherein the valve comprises a rotatable flap to selectively provide the obstruction to the fluid flowing in the flowline.

15. The apparatus as defined in claim 14, wherein the flap is breakable to substantially decrease the obstruction in the flowline provided by the movable scraper.

16. The apparatus as defined in claim 14, wherein the flap comprises a magnetic portion to enable rotation of the flap in response to a magnetic field external to the flowline.

17. The apparatus as defined in claim 1, wherein the movable scraper is cylindrically shaped.

18. The apparatus as defined in claim 1, wherein the outer surface of the movable scraper is flexibly engagable with the inner surface.

19. The apparatus as defined in claim 18, wherein the outer surface is made at least partially of a rubber material.

20. The apparatus as defined in claim 1, wherein the movable scraper is made at least partially of rubber, metal, or ceramic.

21. The apparatus as defined in claim 1, wherein the inner surface is associated with a downhole sensor.

22. The apparatus as defined in claim 1, wherein the deposit comprises at least one of a formation fluid or a drilling fluid.

23. An apparatus to clean an inner surface of a flowline in a downhole tool, comprising:

a body configured to move within a flowline of a downhole tool, wherein the body comprises a central portion to obstruct the flowline so that a fluid flowing in the flowline moves the body in the flowline, and wherein the body has an outer surface configured to engage an inner surface of the flowline so that movement of the outer surface along the inner surface is to clean at least a portion of the inner surface, and wherein the flowline directs fluid to a downhole fluid measurement unit.

24. An apparatus as defined in claim 23, wherein the body is cylindrically shaped.

25. An apparatus as defined in claim 23, wherein the central portion is to selectively obstruct the flowline.

26. An apparatus as defined in claim 25, wherein the central portion comprises a pressure relief member that opens or breaks to substantially reduce an obstruction provided by the body after the outer surface has moved along the inner surface to clean the at least the portion of the inner surface.

27. An apparatus as defined in claim 25, wherein the central portion comprises a movable plate that is to rotate to substantially reduce an obstruction provided by the body after the outer surface has moved along the inner surface to clean the at least the portion of the inner surface.

28. An apparatus as defined in claim 25, wherein the central portion is responsive to a pressure increase in the flowline or a magnetic field external to the flowline to selectively obstruct the flowline.

29. An apparatus as defined in claim 23, further comprising at least one storage location for the body, wherein the at least one storage location holds the body out of a flow path of fluid in the flowline.

30. An apparatus as defined in claim 23, further comprising at least one restricted portion of the flowline to constrain the travel of the body within the flowline.

31. An apparatus to remove a deposit on a surface of a flowline in a downhole tool, comprising:

a movable scraper disposed in a flowline of a downhole tool that includes a magnetic portion to enable movement of the scraper in the flowline in response to a magnetic field, and wherein the movable scraper has a surface configured to engage a corresponding surface of the flowline so that movement of the surface along the corresponding surface removes a deposit on at least a portion of the corresponding surface; and wherein the flowline directs fluid to a downhole fluid measurement unit.

32. The apparatus as defined in claim 31, further comprising a coil to emit the magnetic field, wherein the movable scraper moves within the flowline in response to a change in a position of the coil relative to the flowline.

33. The apparatus as defined in claim 31, further comprising at least one coil to emit the magnetic field, wherein the movable scraper moves within the flowline in response to a magnetic polarity of the at least one coil.

34. The apparatus as defined in claim 31, further comprising one or more structures within the flowline to substantially limit the movement of the scraper.

35. The apparatus as defined in claim 31, wherein the scraper defines a recess that corresponds to at least a portion of a sensor that protrudes into the flowline.

36. The apparatus as defined in claim 31, further comprising a first coil and a second coil, wherein the first coil is to attract the scraper and the second coil is to repel the scraper between a first position and a second position.

37. The apparatus as defined in claim 31, wherein the moveable scraper further comprises a pressure relief member that opens or breaks in response to an increase in fluid pressure in the flowline to substantially decrease an obstruction in the flowline provided by the movable scraper.

38. The apparatus as defined in claim 37, wherein the pressure relief member comprises a membrane or a hydraulic fuse.

* * * * *